US005250386A

United States Patent [19]

Aono et al.

[11] Patent Number: 5,250,386

[45] Date of Patent: * Oct. 5, 1993

[54] DRY IMAGE-FORMING PROCESS

[75] Inventors: Toshiaki Aono; Koichi Nakamura; Kozo Sato; Hiroshi Hara, all of Kanagawa, Japan

[73] Assignee: Fuji Photo Film Co., Ltd., Kanagawa, Japan

[ * ] Notice: The portion of the term of this patent subsequent to Aug. 28, 2007 has been disclaimed.

[21] Appl. No.: 759,648

[22] Filed: Sep. 13, 1991

Related U.S. Application Data

[63] Continuation of Ser. No. 183,345, Apr. 12, 1988, abandoned, which is a continuation of Ser. No. 865,953, May 19, 1986, abandoned, which is a continuation of Ser. No. 590,592, Mar. 16, 1984, abandoned.

[30] Foreign Application Priority Data

Mar. 16, 1983 [JP] Japan ..... 58-42092
Apr. 1, 1983 [JP] Japan ..... 58-55172

[51] Int. Cl.[5] ..... G03C 5/54
[52] U.S. Cl. ..... 430/203; 430/218
[58] Field of Search ..... 430/203, 218, 223, 351, 430/617, 619

[56] References Cited

U.S. PATENT DOCUMENTS

| | | | |
|---|---|---|---|
| 4,124,387 | 11/1978 | Kohrt | 430/203 |
| 4,430,415 | 2/1984 | Aono et al. | 430/203 |
| 4,463,079 | 7/1984 | Naito et al. | 430/203 |
| 4,473,631 | 9/1984 | Hirai et al. | 430/203 |
| 4,473,632 | 9/1984 | Kitaguchi et al. | 430/203 |
| 4,478,927 | 10/1984 | Naito et al. | 430/203 |
| 4,500,624 | 2/1985 | Aono et al. | 430/203 |
| 4,500,626 | 2/1985 | Naito et al. | 430/203 |
| 4,504,568 | 3/1985 | Clark et al. | 430/203 |
| 4,952,479 | 8/1990 | Aono et al. | 430/203 |

FOREIGN PATENT DOCUMENTS

| | | | |
|---|---|---|---|
| 0076492 | 4/1983 | European Pat. Off. | 430/203 |
| 2058383 | 4/1981 | United Kingdom | 430/203 |

*Primary Examiner*—Richard L. Schilling
*Attorney, Agent, or Firm*—Sughrue, Mion, Zinn, Macpeak & Seas

[57] ABSTRACT

A dry image-forming process is disclosed. The dry image-forming process of the invention comprises heat developing a light-sensitive material comprising a support having thereon at least a photosensitive silver halide, a binder, and a dye releasing redox compound said dye releasing redox compound being reductive to the photosensitive silver halide and being capable of releasing a hydrophilic dye upon reaction with the photosensitive silver halide under heating, after or simultaneously with imagewise exposure, to form imagewise a mobile hydrophilic dye and heating, after simultaneously with the heat development, the light-sensitive material together with a dye-fixing layer in the presence of a hydrophilic thermal solvent to thereby transfer the mobile hydrophilic dye onto the dye-fixing layer to form a dye image and fix the dye image. The heat development is carried out in a state containing substantially no water, and the whole of steps are carried out without particular supplying a solvent.

15 Claims, No Drawings

DRY IMAGE-FORMING PROCESS

This is a continuation of application Ser. No. 07/183,345 filed Apr. 12, 1988, now abandoned, which is a continuation of application Ser. No. 865,953, filed May 19, 1986, which is a continuation of application Ser. No. 590,592, filed Mar. 16, 1984, both now abandoned.

FIELD OF THE INVENTION

The present invention relates to a completely dry image-forming process using a silver halide light-sensitive material. More particularly, the invention relates to a process of fixing a color image obtained by heat development on a dye image-fixing layer by heating without using a system containing a solvent.

BACKGROUND OF THE INVENTION

Since a photographic process using silver halide is excellent in photographic properties such as sensitivity and gradation control as compared to other photographic processes such as electrophotography and diazo photographic process, the silver halide photographic process has hitherto been most widely used. Recently, a technique capable of more easily and rapidly obtaining images has been developed by changing an image-forming process of a silver halide photographic material from a conventional wet process such as a process which uses a liquid developer to a dry process such as a developing process which uses heating.

Heat-developable photographic materials are known in this art and the heat-developable materials and image-forming processes using these heat-developable materials are described in, for example, *Shahin Kogaku no Kiso* (The Basis of Photographic Engineering), pages 553-555, published by Corona K. K. in 1979; *Eizo Hooho* (Image Information), page 40, published in Apr., 1978; *Nebletts Handbook of Photography and Reprography,* 7th Ed., pages 32-33, (Van Nostrand Reinhold Company); U.S. Pat. Nos. 3,152,904, 3,301,678, 3,392,020, 3,457,075; U.K. Patents 1,131,108 and 1,167,777; and *Research Disclosure* (RD-17029), pages 9-15, June 1978.

Various processes have been proposed for obtaining dye images by a dry system. For example, for forming color images by a combination of the oxidation product of a developing agent and a coupler, there are proposed a combination of a p-phenylenediamine reducing agent and a phenolic or active methylene coupler in U.S. Pat. No. 3,531,286; p-aminophenol series reducing agents in U.S. Pat. No. 3,761,270; sulfonamidophenol series reducing agents in Belgian Patent 802,519 and in *Research Disclosure,* pages 31-32, Sep. 1975; and combination of a sulfonamidophenol series reducing agent and a 4-equivalent coupler in U.S. Pat. No. 4,021,240.

However, in these processes there is a fault that color images become turbid since images of reduced silver and color images are simultaneously formed at light exposed areas after heat development. For overcoming the fault, there are proposed a process of removing the silver images by liquid processing and a process of transferring the dyes only to another layer, for example, a sheet having an image-receiving layer. However, there remains a fault that it is not easy to discriminate a dye from the reaction mixture and transfer the dye by itself.

Also, a process of introducing a nitrogen-containing heterocyclic ring group into a dye, forming a silver salt, and liberating the dye by heat development is described in *Research Disclosure,* (RD-16966), pages 54-58, May 1978. However, in the process it is difficult to control the liberation of the dye at non-exposed areas, whereby a clear image cannot be obtained and hence the foregoing process is unsuitable for general use.

Also, for forming a positive color image by a heat-sensitive silver dye bleaching process, there are described useful dye bleaching processes in *Research Disclosure,* (RD-14433), pages 30-32, Apr. 1976; *ibid.,* (RD-15227), pages 14-15, Dec. 1976; U.S. Pat. No. 4,235,957, etc.

However, these processes have such faults that additional steps and material are required for accelerating the bleaching of dye, for example, it is required to superpose an activating agent sheet on the light-sensitive material and heat the assembly, and also color images obtained are gradually bleached by reduction with free silver, etc., existing in the light-sensitive material during the preservation of the images for a long period of time.

Furthermore, a process of forming color images by utilizing leuco dyes is described in, for example, U.S. Pat. Nos. 3,985,565 and 4,022,617. However, in the process it is difficult to stably incorporate leuco dyes in photographic materials, that is, the photographic materials containing leuco dyes are gradually colored when they are preserved.

Some of the inventors previously provided an image-forming process using a novel photosensitive material capable overcoming these faults in the conventional processes (European Patent 0076492). This process is an image-forming process wherein a photosensitive material capable of releasing a mobile hydrophilic dye is heated in a state containing substantially no water to release the mobile hydrophilic dye and the hydrophilic dye is transferred onto a dye-fixing layer mainly in the presence of a solvent.

SUMMARY OF THE INVENTION

As the result of further making investigations on such a previous invention, the inventors have discovered that an image composed of a mobile hydrophilic dye which is formed by heating in a state containing substantially no water can be easily transferred by heating without supplying any solvent.

An object of the present invention is, therefore, to provide a process of fixing a hydrophilic dye image formed by heat development, which is performed after or simultaneously with imagewise exposure, on a dye-fixing layer.

Another object of the present invention is to provide a process of forming a hydrophilic dye image having a high quality in a dye-fixing layer by only heating without supplying any solvent in the whole of steps using a heat-developable light-sensitive material containing a dye releasing redox compound capable of releasing a mobile hydrophilic dye upon reaction with a photosensitive silver halide under heating in a state containing substantially no solvent.

A further object of the present invention is to provide a dye-fixing material suited for the image-forming process, which comprises a support having provided thereon one or more layers containing at least a dye-fixing agent, a thermal solvent and a base and/or a base precursor.

That is, the invention relates to a dry image-forming process which comprises heating a light-sensitive material comprising a support having thereon at least a photosensitive silver halide, a binder and a dye releasing redox compound reductive to the photosensitive silver halide and capable of releasing a mobile hydrophilic dye upon reaction with the photosensitive silver halide under heating, after or simultaneously with imagewise exposure, to form imagewise a mobile hydrophilic dye by the action of the imagewise exposure and heating of the light-sensitive material, after or simultaneously with heat development, in the presence of a hydrophilic thermal solvent without particularly supplying a solvent to transfer the mobile hydrophilic dye onto a dye-fixing layer to form a dye image which is then fixed.

DESCRIPTION OF THE PREFERRED EMBODIMENT

In the light-sensitive material used in the present invention, an oxidation reduction reaction occurs between the photosensitive silver halide and the reductive dye releasing redox compound with the exposed photosensitive silver halide as a catalyst upon heating in a state containing substantially no water after or simultaneously with image exposure, whereby an image of a mobile hydrophilic dye released from the dye releasing redox compound, which has become an oxidized product by being oxidized with the silver halide, is obtained together with a silver image at the exposed area.

In the present invention the development step is called "heat development" but it is difficult to distinguish the released mobile hydrophilic dye image by the heat development only since the unreacted dye releasing redox compound is co-present. However, in the present invention, since the dye of the dye image obtained is a mobile hydrophilic dye, the dye can be transferred onto a dye-fixing layer in an atmosphere wherein the hydrophilic dye has an affinity, whereby a dye image having excellent image quality and preservative property can be obtained. This step is "dye fixing" step in the invention. It was already disclosed in European Patent 0076492 that in this case the atmosphere having an affinity with the hydrophilic dye can be realized by mainly supplying a solvent. However, in the present invention, the atmosphere having an affinity with the hydrophilic dye is realized by the existence of a hydrophilic thermal solvent and hence, it is not necessary to particularly supply a solvent. Accordingly, a dye image having a color reproducibility can be formed by a completely dry process without need of supplying a solvent in the whole of steps from light exposure to heat development and dye fixing.

This principle is essentially true in the case of using a negative type silver halide emulsion and in the case of using an autopositive-type silver halide emulsion as the silver halide emulsion for the light-sensitive material. Therefore, in the case of using an autopositive-type silver halide emulsion, a dye image having a good color reproducibility can be obtained in the same manner as in the case of using a negative-type silver halide emulsion except that in the silver image and the mobile dye image obtained at the unexposed areas, only the dye image is transferred onto the dye-fixing layer.

The oxidation-reduction reaction of a photo-sensitive silver halide and a dye releasing redox compound and the subsequently occurred dye-releasing reaction can take place upon heating in a state containing substantially no solvent. The term "heating" referred to herein means heating to 80° C. to 250° C., and the term "a state containing substantially no water" means that the reaction system is in an equilibrium state with moisture in air and hence, water is not supplied for causing the reaction or for accelerating the reaction. Such a state is described in *The Theory of the Photographic Process,* 4th Edition, page 374, Edited by T. H. James, published by Macmillan.

In the present invention, dyes which are released can be selected by selecting dye releasing redox compounds and therefore, various colors can be reproduced. Accordingly, by selecting a combination of dye-releasing redox compounds, multicolor images can be obtained, dye images in the invention include not only monochromatic images bu also multicolor images, and the monochromatic images include a monochromatic image composed of a mixture of two or more colors.

It has hitherto been considered that the dye releasing reaction is caused by the attack of a so-called nucleophilic reagent and the reaction is usually performed in an aqueous solution having a high pH as higher than 10. Therefore, it is quite exceptional that a light-sensitive material shows a high reactivity upon mere heating in a state containing substantially no water as the case of the light-sensitive material used in the invention.

Furthermore, considering from conventional knowledges obtained from a wet development at about normal temperature, it is also quite exceptional that the dye releasing redox compound used in the invention can cause an oxidation-reduction reaction with a silver halide without need of the aid of a so-called auxiliary developing agent (see European Patent 0076492).

The foregoing reaction proceeds particularly well when an organic silver salt oxidizing agent is co-present in the reaction system, and a high image density can be obtained. Therefore, it is a particularly preferred embodiment that an organic silver salt oxidizing agent is co-present in the reaction system.

The dye releasing redox compound which releases a hydrophilic diffusible dye used in the present invention is represented by the following general formula (I):

$$Ra—SO_2—D \quad (I)$$

wherein Ra represents a reducing group capable of being oxidized by the silver halide; and D represents an image forming dye portion containing a hydrophilic group.

Preferably the reducing group Ra in the dye releasing redox compound $Ra—SO_2—D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group Ra include those represented by the following general formulae (II) to (IX).

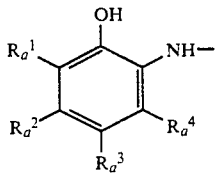

(II)

-continued (III)

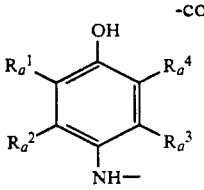

(IV)

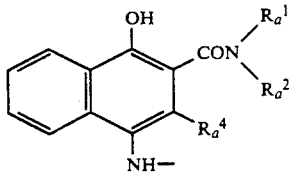

(V)

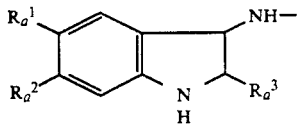

(VI)

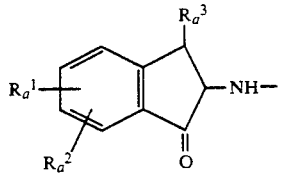

(VII)

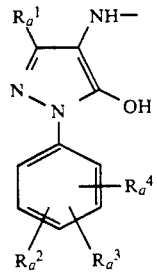

(VIII)

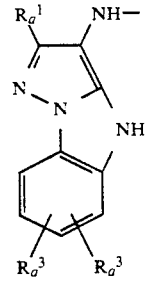

(IX)

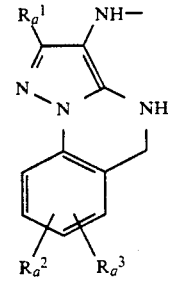

wherein $R_a^1$, $R_a^2$, $R_a^3$ and $R_a^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkyl-sulfonylamino group, an arylsulfonylamino group, a substituted ureido group or a carboalkoxy group, Furthermore, the hydroxy group and the amino group included in the reducing group represented by Ra may be protected by a protective group capable of reproducing the hydroxy group and the amino group by the action of a nucleophilic agent.

In more preferred embodiments of the present invention, the reducing group Ra is represented by the following general formula (X).

(X)

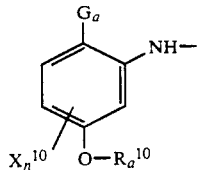

wherein Ga represents a hydroxy group or a group giving a hydroxy group upon hydrolysis; $R_a^{10}$ represents an alkyl group or an aromatic group; n represents an integer of 1 to 3; $X^{10}$ represents an electron donating substituent when n is 1 or substituents, which may be the same or different, one of the substituents being an electron donating group and the second or second and third substituents being selected from an electron donating group or a halogen atom when n is 2 or 3, respectively; wherein $X^{10}$ groups may form a condensed ring with each other or with $OR_a^{10}$, and the total number of the carbon atoms included in $R_a^{10}$ and $X^{10}$ is not less than 8.

Of the reducing groups represented by the general formula (X), more preferred reducing groups Ra are represented by the following general formulae (Xa) and (Xb);

(Xa)

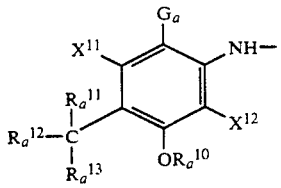

wherein Ga represents a hydroxy group or a group giving a hydroxy group upon hydrolysis; $R_a^{11}$ and $R_a^{12}$, which may be the same or different, each represents an alkyl group or $R_a^{11}$ and $R_a^{12}$ may be bonded to each other to form a ring; $R_a^{13}$ represents a hydrogen atom or an alkyl group; $R_a^{10}$ represents an alkyl group or an aromatic group; $X^{11}$ and $X^{12}$, which may be the same or different, each represents a hydrogen atom, an alkyl group, an alkoxy group, a halogen atom, an acylamino group or an alkylthio group; and $R_a^{10}$ and $X^{12}$ or $R_a^{10}$ and $R_a^{13}$ may be bonded to each other to form a ring, (Xb)

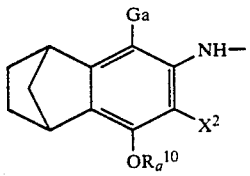

wherein Ga represents a hydroxy group or a group giving a hydroxy group upon hydrolysis; $R_a^{10}$ represents an alkyl group or an aromatic group; $X^2$ represents a hydrogen atom, an alkyl group, an alkoxy group, a halogen atom, an acylamino group or an alkylthio group; and $X^2$ and $R_a^{10}$ may be bonded to each other to form a ring.

Specific examples of the reducing groups represented by the above described general formulae (X), (Xa) and (Xb) are described in U.S. Pat. No. 4,055,428, Japanese Patent Application (OPI) Nos. 12642/81 and 16130/81, respectively.

In other more preferred embodiments of the present invention, the reducing group Ra is represented by the following general formula (XI).

(XI)

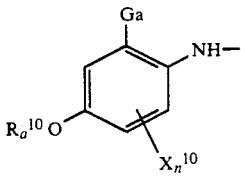

wherein Ga, $X^{10}$, $R_a^{10}$ and n each has the same meaning as Ga, $X^{10}$, $R_a^{10}$ and n defined in the general formula (X).

Of the reducing groups represented by the general formula (XI), more preferred reducing groups Ra are represented by the following general formulae (XIa), (XIb) and (XIc)

(XIa)

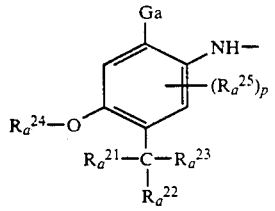

(XIa)

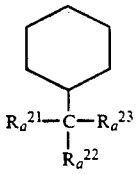

wherein Ga represents a hydroxy group or a group giving a hydroxy group upon hydrolysis; $R_a^{21}$ and $R_a^{22}$, which may be the same or different, each represents an alkyl group or an aromatic group, and $R_a^{21}$ and $R_a^{22}$ may be bonded to each other to form a ring; $R_a^{23}$ represents a hydrogen atom, an alkyl group or an aromatic group; $R_a^{24}$ represents an alkyl group, an alkoxy group, an alkylthio group, an arylthio group, a halogen atom or an acylamino group; p is 0, 1 or 2; $R_a^{24}$ and $R_a^{25}$ may be bonded to each other to form a condensed ring; $R_a^{21}$ and $R_a^{24}$ may be bonded to each other to form a condensed ring; $R_a^{21}$ and $R_a^{25}$ may be bonded to each other to form a condensed ring; and the total number of the carbon atoms included in $R_a^{21}$, $R_a^{22}$, $R_a^{23}$, $R_a^{24}$ and $(R_a^{25})_p$ is more than 7.

(XIb)

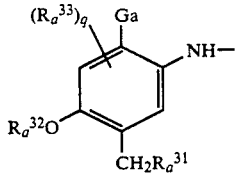

wherein Ga represents a hydroxy group or a group giving a hydroxy group upon hydrolysis; $R_a^{31}$ represents an alkyl group or an aromatic group; $R_a^{32}$ represents an alkyl group or an aromatic group; $R_a^{23}$ represents an alkyl group, an alkoxy group, an alkylthio group, an arylthio group, a halogen atom or an acylamino group; q is 0, 1 or 2; $R_a^{32}$ and $R_a^{33}$ may be bonded to each other to form a condensed ring; $R_a^{31}$ and $R_a^{33}$ may be bonded to each other to form a condensed ring; and the total number of the carbon atoms included in $R_a^{31}$, $R_a^{32}$ and $(R_a^{33})_q$ is more than 7.

(XIc)

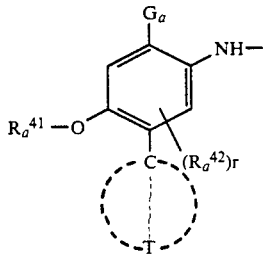

wherein Ga represents a hydroxy group or a group giving a hydroxy group upon hydrolysis; $R_a^{41}$ represents an alkyl group or an aromatic group; $R_a^{42}$ represents an alkyl group, an alkoxy group, an alkylthio group, an arylthio group, a halogen atom or an acylamino group; r is 0, 1 or 2; the group of

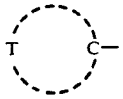

represents a group in which 2 to 4 saturated hydrocarbon rings are condensed, the carbon atom

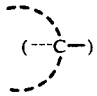

in the condensed ring which is connected to the phenol nucleus (or a precursor thereof), represents a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R_a^{41}$ or $R_a^{42}$ and the group of

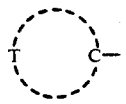

may be bonded to each other to form a condensed ring; and the total number of the carbon atoms included in $R_a^{41}$, $(R_a^{42})_r$ and the group of

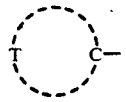

is not less than 7.

Specific examples of the reducing groups represented by the above described general formulae (XI), (XIA), (XIB) and (XIc) are described in Japanese Patent Application (OPI) Nos. 16131/81, 650/82 and 4043/82.

The essential part in the groups represented by the general formulae (III) and (IV) is a para(sulfonyl-)aminophenol part. Specific examples of these reducing groups are described in U.S. Pat. Nos. 3,928,312 and 4,076,529, U.S. Published Patent Application B Ser. No. 351,673, U.S. Pat. Nos. 4,135,929 and 4,258,120. These groups are also effective for the reducing group Ra according to the present invention.

In still other more preferred embodiments of the present invention, the reducing group Ra is represented by the following general formula (XII).

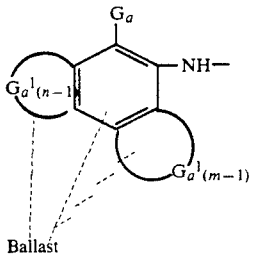

(XII)

wherein Ballast represents a diffusion-resistant group; Ga represents a hydroxy group or a precursor of a hydroxy group; $G_a^1$ represents an aromatic ring directly condensed to the benzene nucleus to form a naphthalene nucleus; and n and m are dissimilar positive integers of 1 to 2.

Specific examples of the reducing groups represented by the above described general formula (XII) are described in U.S. Pat. No. 4,053,312.

The reducing groups represented by the above described general formulae (V), (VII), (VIII) and (IX) are characterized by containing a heterocyclic ring. Specific examples of the groups are described in U.S. Pat. No. 4,198,235, Japanese Patent Application (OPI) No. 46730/78 and U.S. Pat. No. 4,273,855.

Specific examples of the reducing groups represented by the general formula (VI) are described in U.S. Pat. No. 4,149,892.

Characteristics required for the reducing group Ra are as follows.

1. It is rapidly oxidized by the silver halide to effectively release a diffusible dye for image formation by the function of the dye releasing activator.

2. The reducing group Ra has an extensive hydrophilic property, because it is necessary for the dye releasing redox compound to be diffusion-resistant in a hydrophilic or hydrophobic binder and that only the released dye has diffusibility.

3. It has excellent stability to heat and to the dye releasing activator and does not release the image forming dye until it is oxidized; and 4. It is easily synthesized.

In the following, specific examples of preferred reducing groups Ra which satisfy the above described requirements are shown. In the examples, NH— represents the bond to the dye portion.

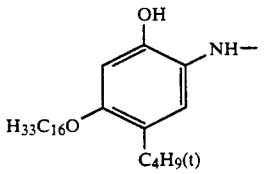

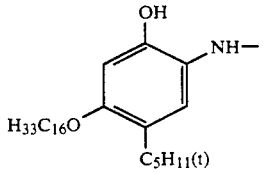

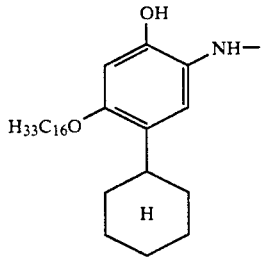

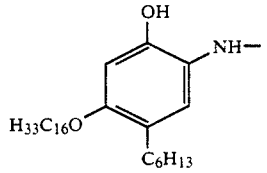

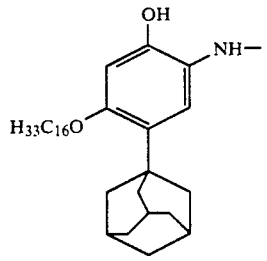

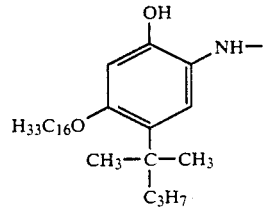

-continued
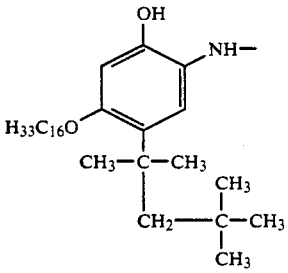
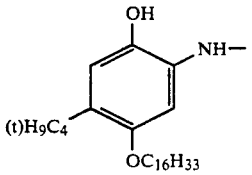
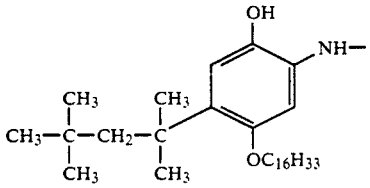
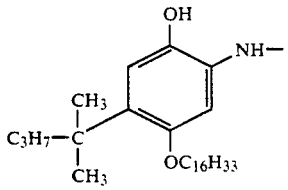
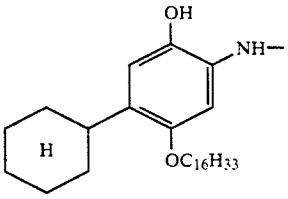
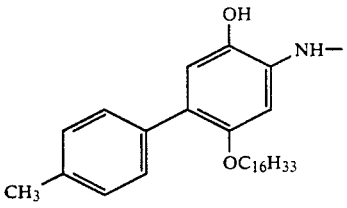
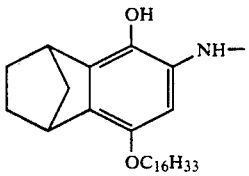
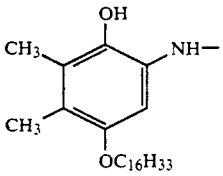
-continued
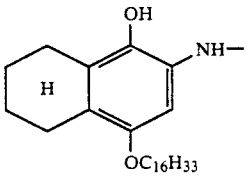
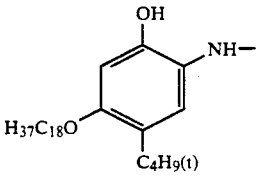
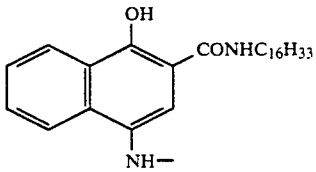
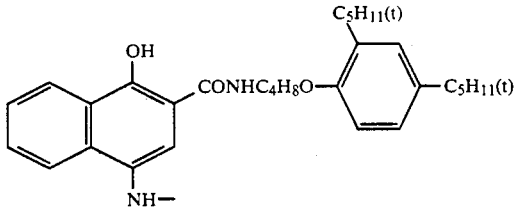
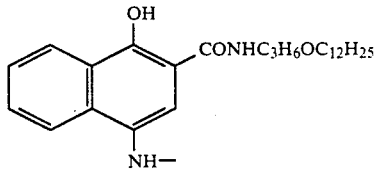
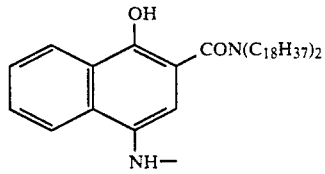
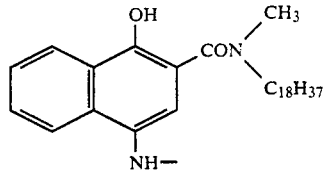
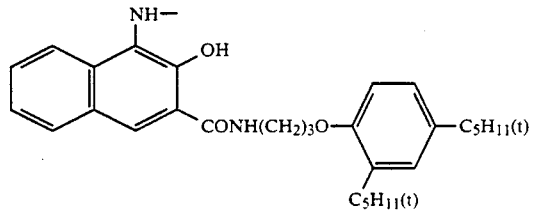
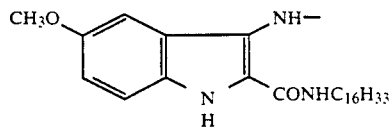

-continued

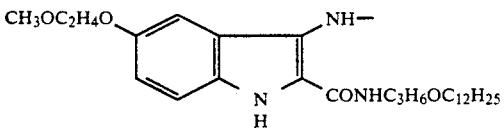

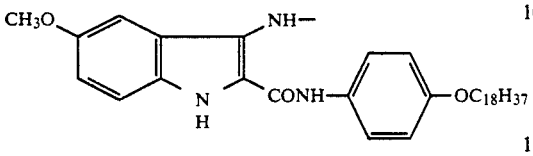

Examples of dyes which can be used for image forming dye include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.

Yellow:

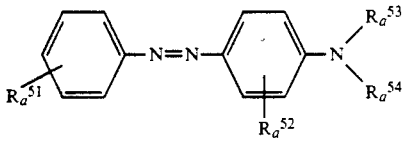

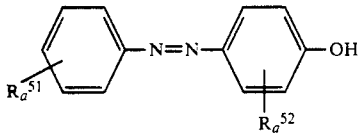

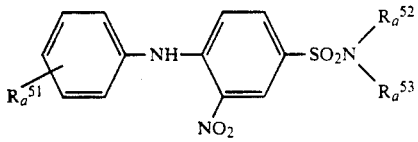

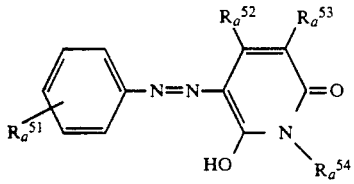

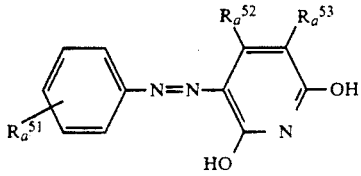

-continued

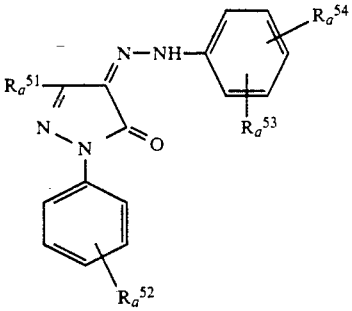

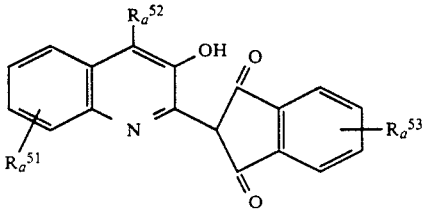

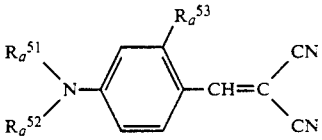

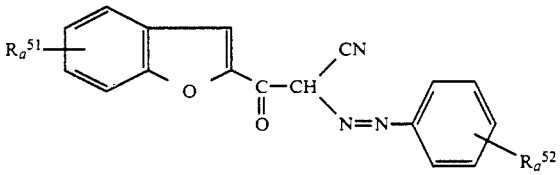

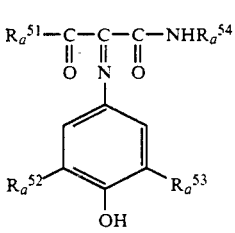

Magenta:

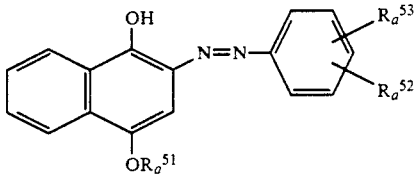

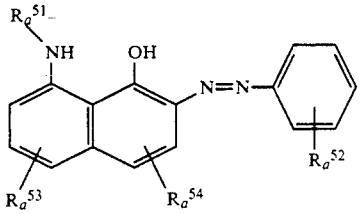

-continued
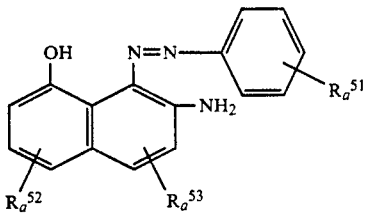
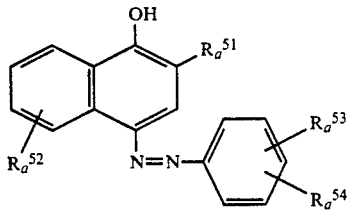
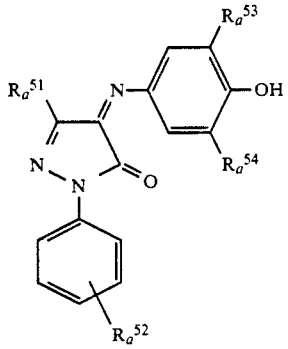
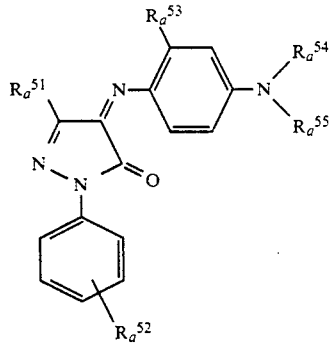
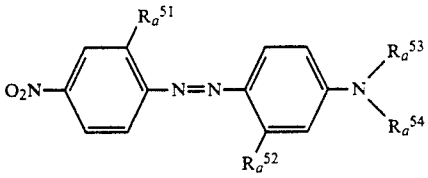
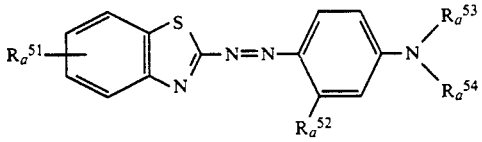
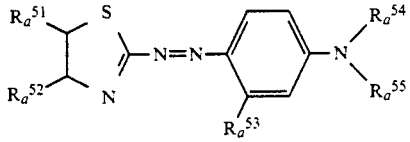
-continued
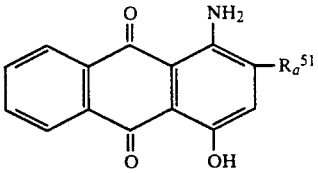
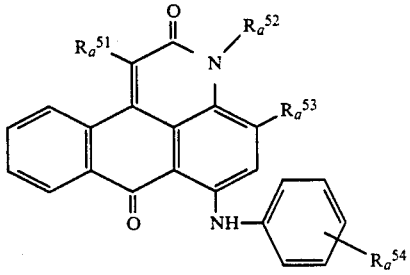
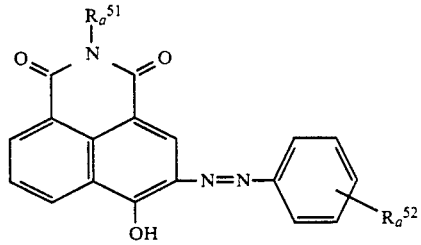
Cyan:
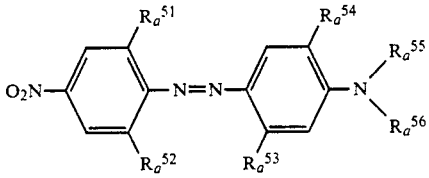
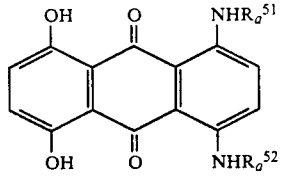
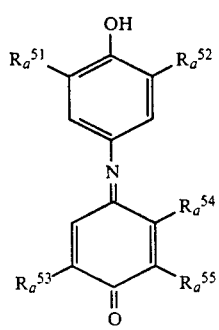

-continued

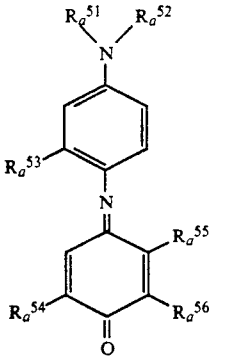

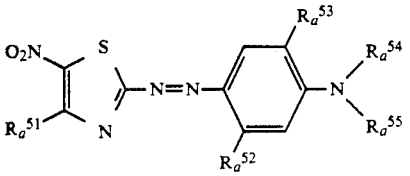

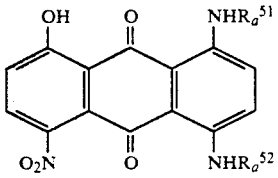

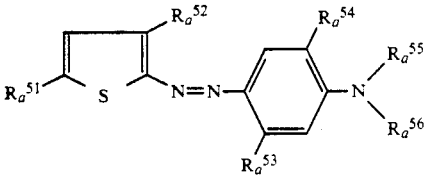

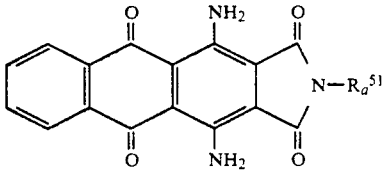

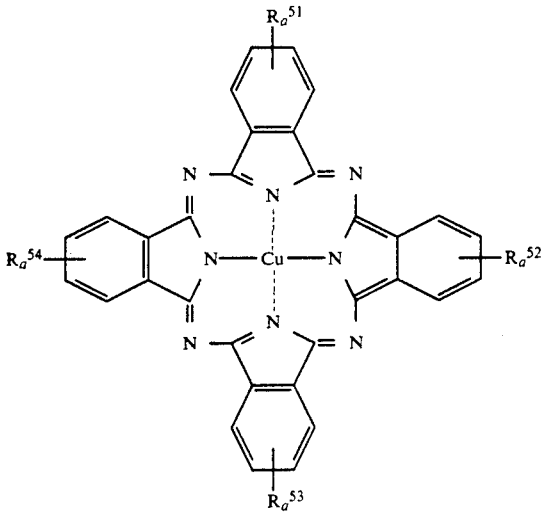

-continued

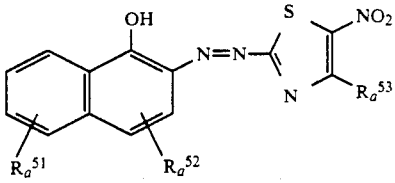

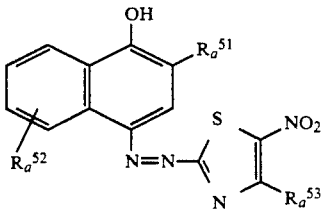

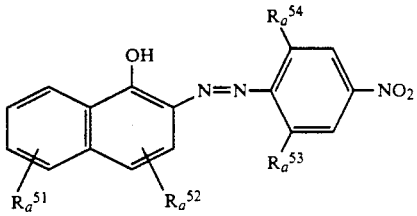

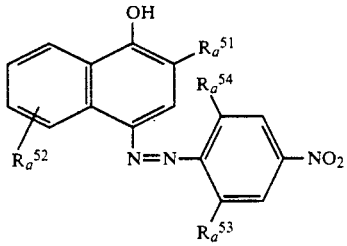

In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and
4. It is easily synthesized.

Specific examples of preferred image forming dyes which satisfy the above described requirements are described in the following. In the examples, $H_2NSO_2$— represents a group necessary to bond to the reducing group.

Yellow

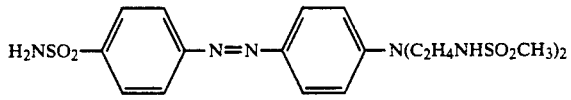

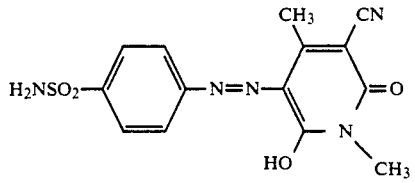

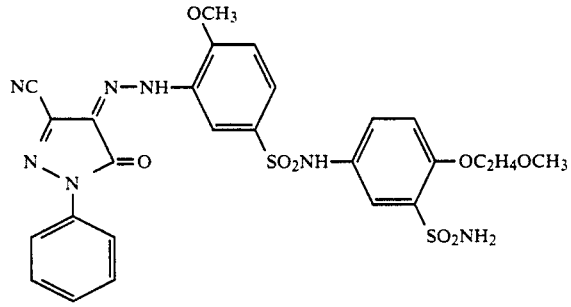

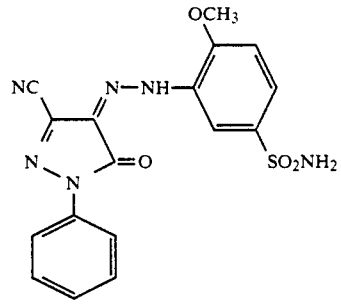

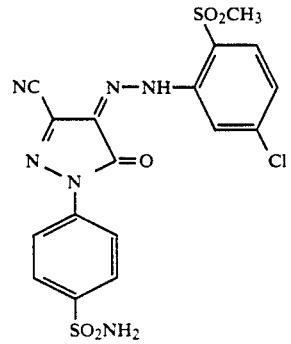

-continued
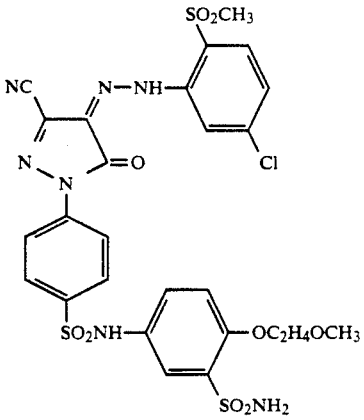
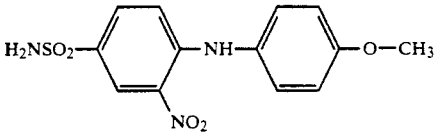
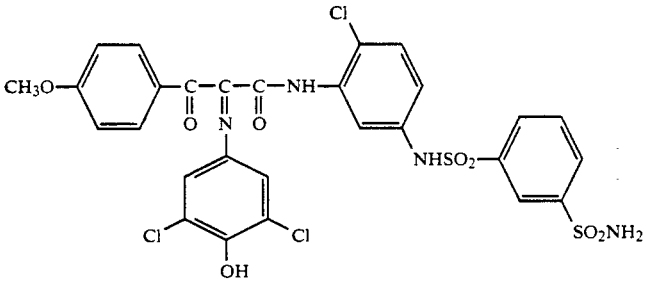
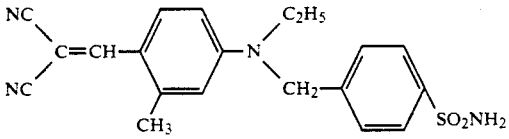
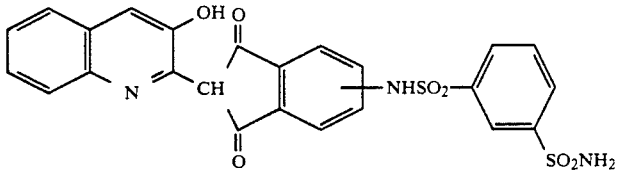
Magenta
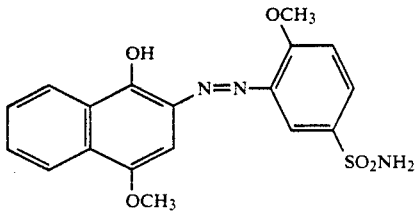

-continued
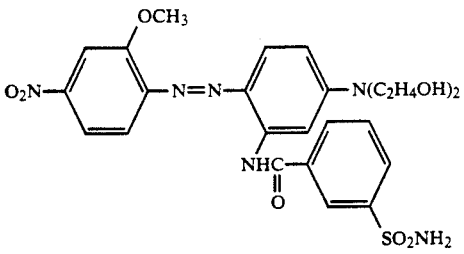
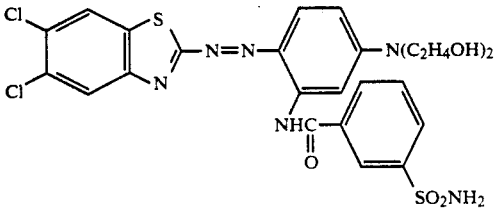
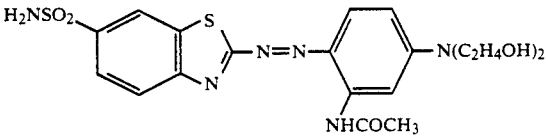
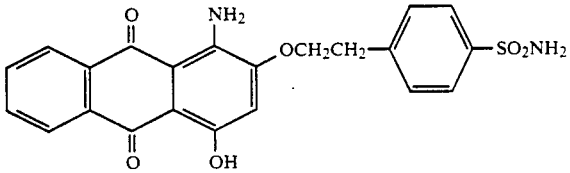
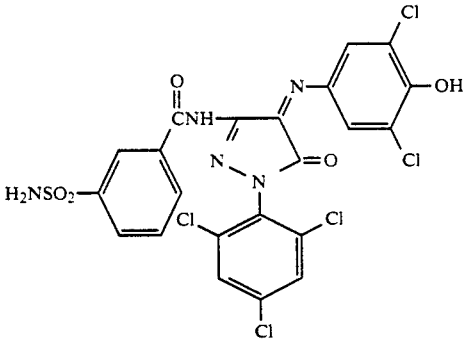
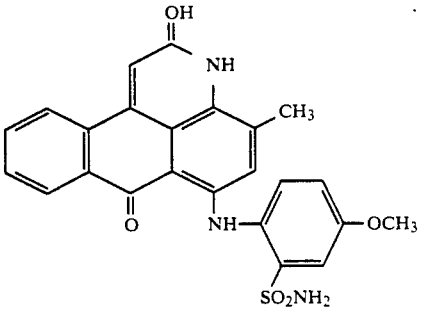

-continued
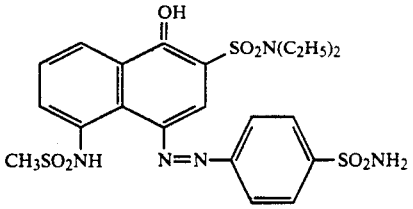
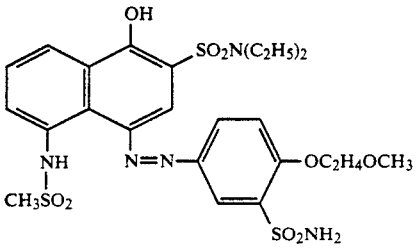
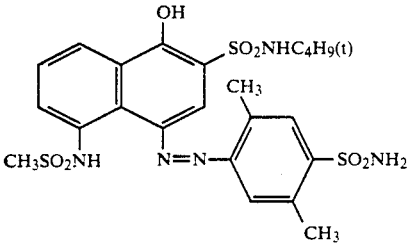
Cyan
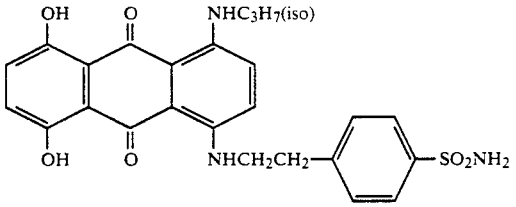
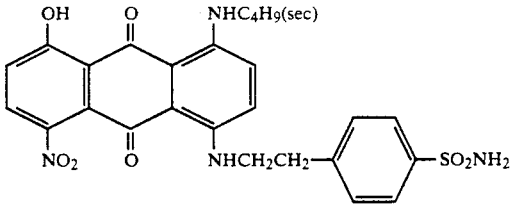
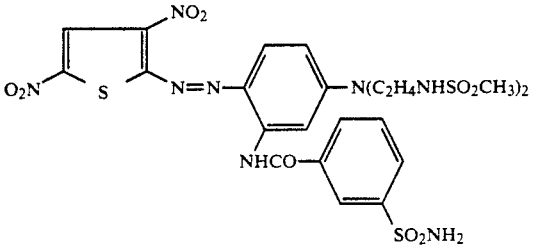

-continued

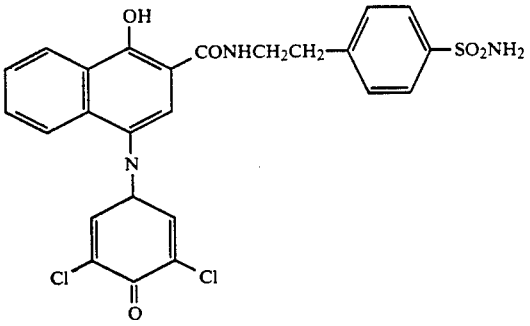

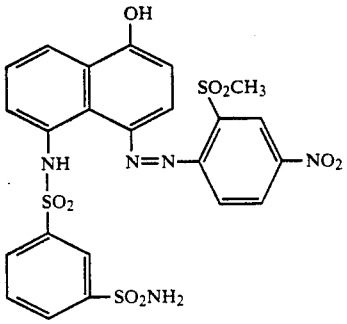

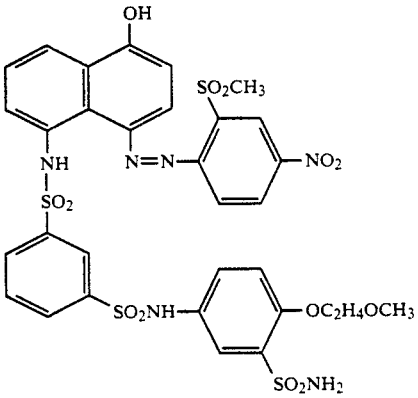

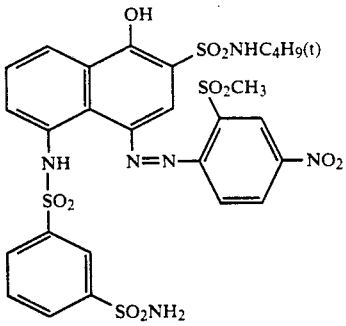

Specific examples and synthesis examples of the dye releasing redox compound which can be used in the present invention are disclosed in European Patent 0076492.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, 8-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

An amount of the organic solvent having a high boiling point used in the present invention is 10 g per g of the dye releasing redox compound used or less and preferably 5 g per g or less.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its particle. That is, the silver halide the X-ray diffraction pattern of which shows that of pure silver iodide is particularly preferred.

In photographic materials a silver halide containing two or more kinds of halogen atoms can be used. Such a silver halide yields a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the present invention a particularly preferred embodiment is to use an organic silver salt oxidizing agent in the light-sensitive material. In this case, the silver halide used is not always required to have a feature that the silver halide contains a pure silver iodide crystal in the case of using silver halide solely, but all silver halides used in the field of the art can be used.

The organic silver salt oxidizing agent used in the invention is one which reacts with, when heated at above 80° C., preferably at above 100° C. in the presence of an exposed silver halide, the foregoing image-forming material or, if necessary, a reducing agent which exists together with the image-forming material to form a silver image.

As described above, in the present invention the light-sensitive material coloring in higher density can be obtained by using an organic silver salt oxidizing agent together with the silver halide in the light-sensitive material.

Examples of the organic silver salt oxidizing agent are silver salts of organic compounds having a carboxy group and typically silver salts of aliphatic carboxylic acids and silver salts of aromatic carboxylic acids.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phanylacetate, silver pyromellitate, a silver salt of 3-carboxymethyl-4-methyl-4-thiazoline-2-thione, etc., as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycol acetic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

In the present invention the silver salts as described in *Research Disclosure,* Vol. 170, No. 17029 of June, 1978 and organic metal salts such as copper stearate, etc. can be also used as the foregoing various silver salts. The organic silver salt oxidizing agents may be used solely or as a mixture of two or more thereof.

In the present invention, if necessary, the so-called auxiliary developing agent can be used even when the dye releasing redox compound is used. The auxiliary developing agent in this case is a compound which is oxidized upon the silver halide to form its oxidized product having an ability to oxidize the reducing group Ra in the dye releasing redox compound.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohydroquinone, dichlorohydroquinone, etc., alkoxy substituted hydroquinones such as methoxyhydroquinone, and polyhydroxybenzene derivatives such as methyl hydroxynaphthalene, etc. Further, methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones and hydroxy tetronic acids are useful.

The auxiliary developing agent can be used in an amount of a fixed range. A suitable range is 0.0005 time by mol to 20 times by mol based on silver. A particularly suitable range is 0.001 time by mol to 4 times by mol.

The heat development mechanism in the present invention upon heating has not yet been sufficiently clarified but is considered as follows.

When the light-sensitive material is exposed to light, a latent image is formed on silver halide having photosensitivity as described in T. H. James, *The Theory of the Photographic Process,* 3rd Edition, pages 105–148.

Furthermore, when the light-sensitive material is heated, the dye releasing redox compound of the invention acts as a reducing agent to reduce the silver halide and/or the organic silver halide oxidizing agent with the latent image nuclei as a catalyst to form silver, and the dye releasing redox compound itself is oxidized. The thus oxidized dye releasing redox compound is cleaved to release a dye. In this case when a nucleophilic agent exists, the dye releasing reaction can be accelerated. Also, when the organic silver salt oxidizing agent is further used together, it is necessary for quickly initiating the reaction that the silver halide and the organic silver salt oxidizing agent exist within a substantially effective distance from each other. Accordingly, it is preferred that the silver halide and the organic silver halide oxidizing agent exist in the same layer.

In the development by heating a long time is required for finishing the development reaction since in this case, the diffusion of the reaction molecules is restricted different from the case of a so-called wet development. However, too long heating for development is undesirable since in such a case, the occurrence of the heat reaction at the unexposed areas cannot be disregarded, whereby so-called fog generates.

In the invention a thermal solvent can be used as a means for improving the foregoing inconvenience. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an —$SO_2$— or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to 28 (Dec., 1976), etc.

The role of the thermal solvent in the invention is not always clear but it is considered that the main role is to accelerate the diffusion of the reaction molecules at development.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Useful sensitizing dyes include those described in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588, Japanese Patent Publication Nos. 14030/69 and 24844/77, etc.

These sensitizing dyes can be employed individually, and can also be employed in combination thereof. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,430, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a super-sensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

In the invention various dye releasing activators can be used by various manners, for example, by incorporating them in any one of the layers of the light-sensitive material or the dye-fixing material. The dye releasing activator is a compound capable of accelerating the oxidation-reduction of the photosensitive silver halide and/or the organic silver salt oxidizing agent with the dye releasing redox compound or capable of nucleophilically reacting with the oxidized dye releasing redox compound in the subsequent dye releasing reaction to accelerate the release of dye. Bases or base precursors are useful as the dye releasing activators. In the invention it is particularly advantageous for accelerating the reaction to use these dye releasing activators, but in the case of incorporating the dye releasing activators in the light-sensitive material, it is necessary to select the dye releasing activator which does not reduce the preservative property of the light-sensitive material. Examples of preferred bases are amines which include trialkylamines, hydroxylamines, aliphatic polyamines, N-alkyl substituted aromatic amines, N-hydroxyalkyl substituted aromatic amines and bis[p-(dialkylamino)-phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base precursor is a substance which releases a basic component by heating. Examples of typical base precursors are described in British Patent 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color photographic material in order to accelerate development and accelerate release of a dye.

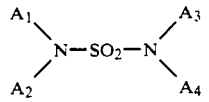

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

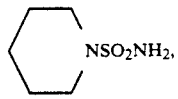

etc.

The above described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

A support used in the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may by used. The polyesters described in U.S. Pat. Nos. 3,634,089 and 3,725,070 are preferably used.

A coating composition used in the invention can be prepared by blending, before use, a silver halide and an organic metal salt oxidizing agent formed separately, and it is also effective for the preparation of the coating composition to blend both the components in a ball mill for a long period of time. It is also effective to add a halogen-containing compound to the organic silver salt oxidizing agent to form a silver halide with silver in the organic silver salt oxidizing agent.

Method of preparing these silver halide and organic silver salt oxidizing agents and manners of blending them are described in Research Disclosure, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The photographic emulsion layer and other hydrophilic colloid layers in the light-sensitive material of the present invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schoufeldt N. Pergamon Press, 1969). Among the nonionic surface active agents described in the above mentioned references, those capable of satisfying the above described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, though it is not so necessary to further incorporate substances or dyes for preventing irradiation or halation in the light-sensitive material, because the light-sensitive material is colored by the dye releasing redox compound, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 2,681,294 and drying in the same manner as used in preparing the heat-developable light-sensitive layer of the present invention, by which the light-sensitive material is obtained.

If necessary, two or more layers may be applied at the same time by the method as described in U.S. Pat. No. 2,761,791 and British Patent 837,095.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful.

In the present invention, the light-sensitive material can be heated for development by an ordinary means such as a simple heating plate, a heating iron, a heat roller, a heating element utilizing carbon or titanium white, or a similar means.

In the image-forming process of the invention wherein a hydrophilic mobile dye is transferred onto a dye-fixing layer by heating the light-sensitive material in the presence of a hydrophilic thermal solvent, the transfer of the mobile dye may be initiated simultaneously with the release of the dye or after completing the release of the dye. Accordingly, heating for the transfer of the mobile dye may be after heat development or simultaneously with heat development. The term "heating simultaneously with heat development" means that heating for development also acts as heating for transferring the dye released. The optimum heating temperature for development and the heating time necessary for the development do not always coincide with those for transferring the dye and hence, the heating temperatures may be selected independently.

Since the heating temperature for transferring the dye is 60° C. to 250° C. from the viewpoints of preservative property and workability of the light-sensitive material, etc., a material which exhibits the action as a hydrophilic thermal solvent in this temperature range may be properly used. It is, as a matter of course, necessary that the hydrophilic thermal solvent assists the quick transfer of dye, but considering also the heat resistance of the light-sensitive material, etc., the hydrophilic thermal solvent is required to have a melting point of 40° C. to 250° C., preferably 40° C. to 200° C., more preferably 40° C. to 150° C.

The "hydrophilic thermal solvent" referred to in the invention is defined to be a compound which is in a solid state at room temperature but becomes in a liquid state upon heating, has an (inorganic property/organic property) value of larger than 1, and has a solubility in water at room temperature of higher than 1. In this case, the term "inorganic property/organic property" is a conception for estimating the properties of a compound and is described in detail in, for example, *Kagaku no Ryoiki* (The Domain of Chemistry), 11, page 719 (1957).

Since the hydrophilic thermal solvent has a role for assisting the transfer of the hydrophilic dye, it is preferred that the hydrophilic thermal solvent is a compound capable of acting as a solvent for the hydrophilic dye.

It is known by experiment that in a preferred solvent for dissolving therein an organic compound, the (inorganic property/organic property) value of the solvent is close to the (inorganic property/organic property) value of the organic compound. On the other hand, the (inorganic property/organic property) value of the dye releasing redox compound used in the present invention is about 1, and the (inorganic property/organic property) value of the hydrophilic dye released from the dye releasing redox compound is larger than the (inorganic property/organic property) value of the dye releasing redox compound and is preferably larger than 1.5, more preferably larger than 2. Since it is preferred that the hydrophilic thermal solvent used in the invention transfers only the hydrophilic dye and does not transfer the dye releasing redox compound, it is necessary that the (inorganic property/organic property) value of the hydrophilic thermal solvent is larger than the (inorganic property/organic property) value of the dye releasing redox compound. That is, it is necessary that the (inorganic property/organic property) value of the hydrophilic thermal solvent used in the invention be larger than 1, preferably larger than 2.

On the other hand, considering from the viewpoint of the size of molecule, it is preferred that molecules existing surrounding the transferring dye do not hinder the transfer of the dye and can also transfer by themselves. Accordingly, it is preferred that the molecular weight of the hydrophilic thermal solvent used in the invention be low, i.e., less than about 200, preferably less than about 100.

It is enough that the hydrophilic thermal solvent used in the invention can substantially assist the transfer of the hydrophilic dye formed from the dye releasing redox compound by heat development onto a dye-fixing layer. Therefore, the hydrophilic thermal solvent may be incorporated in not only a dye-fixing layer but also a photosensitive layer or in both the dye-fixing layer and the photosensitive layer. Furthermore, an independent layer containing a hydrophilic thermal solvent may be provided in the light-sensitive material and/or independent dye-fixing material having the dye-fixing layer. However, from the viewpoint of increasing the transfer efficiency of the dye onto the dye-fixing layer, it is preferred that the hydrophilic thermal solvent be incorporated in the dye-fixing layer and/or a layer adjacent to the dye-fixing layer.

The hydrophilic thermal solvent is usually dissolved in water and dispersed in a binder, but it may be used by dissolving in an alcohol such as methanol, ethanol, etc.

The hydrophilic thermal solvent used in the invention can be used in a coating amount of 5 to 500% by weight, preferably 20 to 200% by weight, more preferably 30 to 150% by weight, based on the total coating amount of the coating compositions for the light-sensitive material and,,or the dye-fixing material.

As the hydrophilic thermal solvent, there are, for example, ureas, pyridines, amides, sulfonamides, imides, alcohols, oximes, and other heterocyclic compounds.

Then, practical examples of the hydrophilic thermal solvent used in the invention are illustrated below.

(1) $H_2N\overset{O}{\overset{\|}{C}}NH_2$, (2) $H_2N\overset{O}{\overset{\|}{C}}NHCH_3$ (3) $H_2N\overset{O}{\overset{\|}{C}}NHC_2H_5$, (4) $CH_3NH\overset{O}{\overset{\|}{C}}NHCH_3$ (5) $HOCH_2NH\overset{O}{\overset{\|}{C}}NH_2$ (6) $HOCH_2NH\overset{O}{\overset{\|}{C}}NHCH_2OH$ (7) $HOC_2H_4NH\overset{O}{\overset{\|}{C}}NHC_2H_4OH$ (8) $H_2N\overset{O}{\overset{\|}{C}}NHC_2H_4OH$ (9) $H_2N\overset{O}{\overset{\|}{C}}N(C_2H_4OH)_2$ (10)

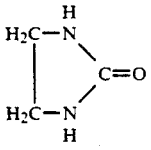

(11)

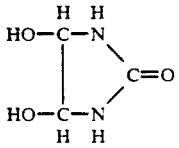

(12) $H_2N-\overset{O}{\overset{\|}{C}}-N(CH_3)_2$

-continued (13)

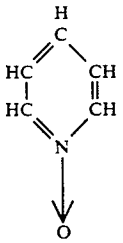

(14)

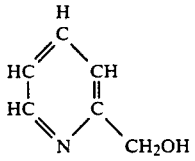

(15)

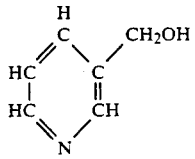

(16)

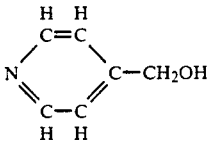

(17)

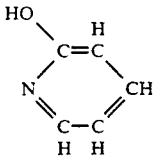

(18)

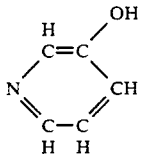

(19)

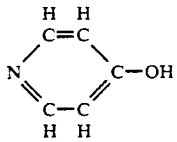

(20)

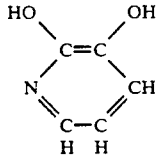

(21)

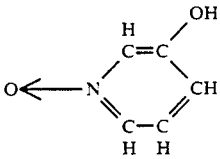

-continued
(22)
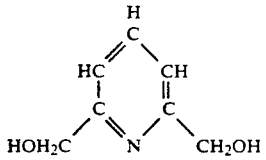
(23)
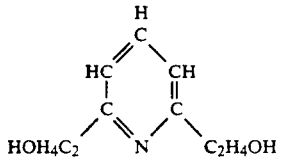
(24)
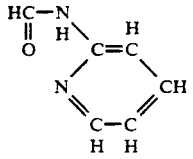
(25)
$(HCNH)_2CH_2$,
(26)
$CH_3CNH_2$
(27)
$(CH_3CNH)_2CH_2$.
(28)
$CH_2{=}CH{-}C({=}O){-}NH_2$
(29)
$HOC_2H_4CNH_2$.
(30)
$HOCH_2CNH_2$
(31)
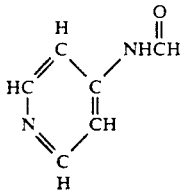
(32)
$NCCH_2CNH_2$
(33)
$(CH_3)CH(OH){-}C({=}O){-}NH_2$
(34)
$CH_3SO_2NH_2$.
(35)
$HOCH_2SO_2NH_2$
(36)
$H_2NSO_2NH_2$.
(37)
$3HCNH3O_2NH_2$
(38)
$HOCH_2SO_2{-}NHCH_3$ ,
-continued
(39)
$(CH_3)_2N{-}SO_2NH_2$
(40)
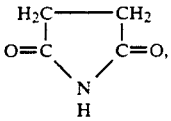
(41)
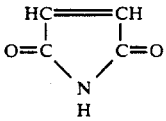
(42)
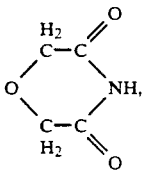
(43)
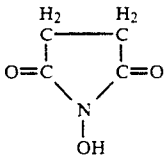
(44)
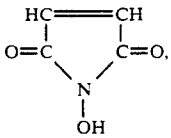
(45)
$(CH_3CO)_2NH$
(46)
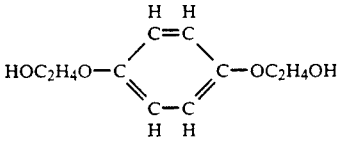
(47)
$HOCH_2(CHOH)_3CH_2OH$.
(48)
$CH_3C(CH_2OH)_3$,
(49)
$C_2H_5C(CH_2OH)_3$
(50)
$O_2NC(CH_2OH)_3$,
(51)
Sorbitol
(52)
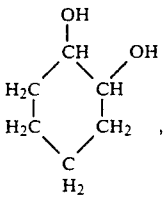
(53)
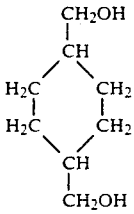

-continued $HOCH_2-CH=CH-CH_2OH$ (54)

$CH_3CH=NOH$, (55)

$HON=CHCH=NOH$ (56)

$CH_3C=NOH$, (57)
$|$
$CH_3C=O$ $HOCH_2CH=NOH$ (58)

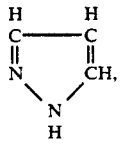 (59)

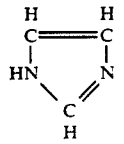 (60)

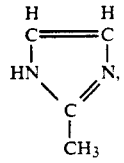 (61)

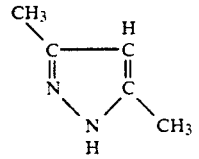 (62)

In the foregoing specific compounds illustrated above as the hydrophilic thermal solvent, the compounds (1), (2), (3), and (10) in ureas, the compounds (17) and (19) in pyridines, the compounds (26), (30), and (33) in amides, the compounds (34) and (36) in sulfonamides, the compounds (40), (41), (43), and (44) in imides, and the compounds (46) and (54) in alcohols are particularly preferred. The foregoing compounds used as the hydrophilic thermal solvent may be used solely or as a mixture of two or more thereof.

In the invention, it is necessary to transfer a mobile hydrophilic dye formed imagewise by the heat development performed simultaneously with or after image exposure and fix the mobile dye onto a dye-fixing layer. Accordingly, the light-sensitive material of this invention is composed of a support having thereon at least a photo-sensitive layer (I) containing a silver halide, an organic silver salt oxidizing agent which may be used if necessary, a dye releasing redox compound which is also a reducing agent for the organic silver salt oxidizing agent, and a binder and a dye-fixing layer (II) capable of receiving a mobile hydrophilic dye formed in the layer (I). Such a photosensitive layer (I) and a dye-fixing layer (II) may be formed on the same support or separate supports respectively. The dye-fixing layer (II) and the photo-sensitive layer (I) may be peeled off from each other. For example, after imagewise exposure and then uniform heating, the dye-fixing layer (II) or the photosensitive layer (I) may be peeled off from the other. Also, in case that a light-sensitive material having the photo-sensitive layer (I) on a support and a dye-fixing material having the dye-fixing layer (II) on another support are prepared separately, after imagewise exposing the light-sensitive material and uniformly heating, the dye-fixing material is superposed on the resulting light-sensitive material to thereby transfer the mobile dye onto the dye-fixing layer (II). Further, there may be a manner that only the photosensitive layer (I) is imagewise exposed and the dye-fixing layer (II) is then superposed thereon, followed by uniformly heating.

The light-sensitive material can be closely brought into contact with the dye-fixing material by usual manners such as those by press roller, etc., and in this case, for sufficiently performing the close contact of both the materials, the heating is employable during the contacting.

In case that after the heat development after or simultaneously with imagewise exposure, the surface of the light-sensitive material is closely brought into contact with the dye-receiving surface of the dye-fixing material and then heated, the latter heating can contribute to only the dye transfer and hence, the heating temperature and the heating time for the latter heating may be selected independent on the heating for the development.

In the case of employing such method, it is preferred to perform the heating for development such that the heating contributes to the dye transfer as less as possible, and that the reaction for the development is finished in a short period of time. On the other hand, it is preferred for obtaining a sharp image that the heating for transferring the dye released imagewise is performed at a temperature of as low as possible such that the heat reaction of the unexposed area does not occur, in a proper range of a transferring period of time.

The dye-fixing layer (II) may have a white reflection layer. For example, a layer of titanium dioxide dispersed in gelatin may be formed on a mordanting layer provided on a transparent support. The titanium dioxide layer forms a white opaque layer and hence, when the transferred dye image is viewed from the side of the transparent support, a reflection-type color image can be viewed.

The dye transfer from the light-sensitive layer to the dye-fixing layer can be carried out using a dye transfer assistant. Examples of useful dye transfer assistant include water and an alkaline aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The dye-fixing layer may contain a dye mordant for fixing the dye, a hydrophilic thermal solvent for assisting the transfer of the dye, a base and/or a base precursor for accelerating the dye releasing reaction, etc., and further a binder for these materials. When the dye-fixing layer is formed on a support other than the support of the light-sensitive material, the foregoing embodiment that the dye-fixing layer contains the base and/or the base precursor is particularly preferred.

Since in the present invention, the dye in the light-sensitive material may transferred into the individually provided dye-fixing material, in order to obtain a high-quality ultimate image fixed in the dye-fixing material, a specific means is required. That is, in order to increase the quality of the dye image transferred onto the dye-fixing layer, it is useful to incorporate a base and/or a base precursor into any one of the layers constituting the dye-fixing material.

Especially, it is preferred to incorporate a base and/or a base precursor into the dye-fixing layer or a layer provided on the dye-fixing layer because the image density is sufficiently high as well as a sharp dye image can be obtained. As such a base and/or base precursor, the above-described bases and/or base precursors as the dye releasing activators useful in the light-sensitive material can, for example, be exemplified.

In the present invention, the ultimate image is formed in the dye-fixing material which is not light-sensitive. In this case, since the function for imparting "light sensitivity" and that for fixing the ultimate image be imparted to the light-sensitive material and the dye-fixing material independently, materials which sufficiently exhibit the respective functions can be widely selected.

As the base and/or base precursor used in the dye-fixing material of the invention, usual inorganic or organic bases and/or base precursors are useful. The "base precursors" referred to in the invention mean ones releasing a basic component upon thermal decomposition.

Examples of the inorganic base include hydroxides of alkali metals or alkaline earth metals, diphosphates, triphosphates, borates, carbonates, quinolinates, pyrophosphates, metaphosphates, ammonium hydroxide, quaternary alkylammonium hydroxides, and other hydroxides. Specific examples of these inorganic bases include lithium hydroxide, sodium hydroxide, potassium hydroxide, barium hydroxide, sodium carbonate, potassium carbonate, sodium quinolinate, potassium quinolinate, sodium diphosphate, potassium diphosphate, sodium triphosphate, potassium triphosphate, sodium pyrophosphate, potassium pyrophosphate, sodium metaphosphate, potassium metaphosphate, borax, ammonium hydroxide, tetramethylammonium, tetrabutylammonium, ammonia and the like.

Examples of the organic base used for the dye releasing activator of the present invention include aliphatic amines, aromatic amines, heterocyclic amines, amidines, cyclic amidines, quanidines, and cyclic quanidines, with those having a pKa of higher than 8 being particularly useful. In the invention, precursors of these organic bases can be used as preferred base precursors. Examples of such base precursors include salts of thermally decomposable organic acids such as trichloroacetic acid, cyanoacetic acid, acetoacetic acid, etc., and salts of 2-carboxy carboxide as disclosed in U.S. Pat. No. 4,088,496. Further, base precursors as disclosed in British Patent 988,945, U.S. Pat. No. 3,220,846 and Japanese Patent Application (OPI) No. 22625/75 can also be used. Still further, bases which are used as alkaline agents and buffers in the conventional photographic materials and their treating solutions may also be used.

Preferred examples of the organic base which can be used in the present invention include guanidine trichloroacetate, piperidine trichloroacetate, morpholine trichloroacetate, p-toluidine trichloroacetate, and 2-picoline trichloroacetate. Further, the compounds as listed below can also be used.

$MeNH_2$. $Me_2NH$. $EtNH_2$

-continued $Et_2NH$, $C_4H_9NH_2$ $(C_4H_9)_2NH$, $HOC_2H_4NH_2$ $(HOC_2H_4)_2NH$, $H_2NC_2H_4NH_2$

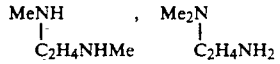

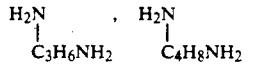

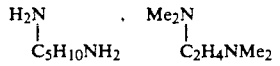

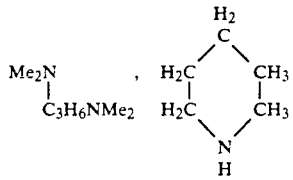

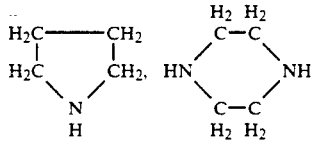

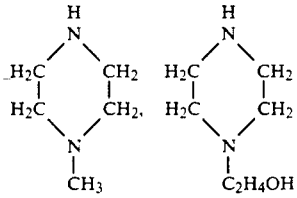

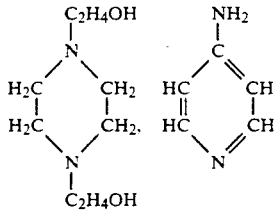

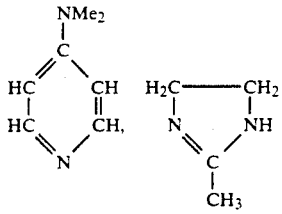

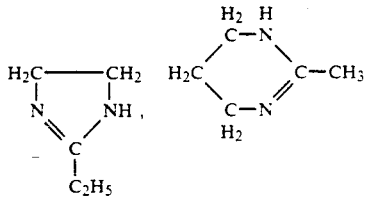

-continued

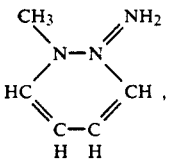

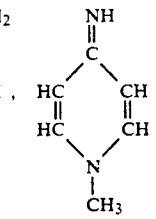

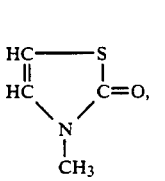

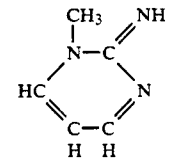

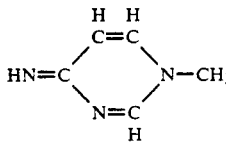

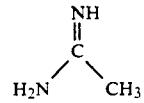

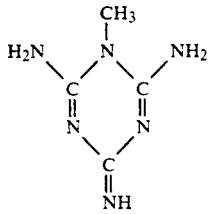

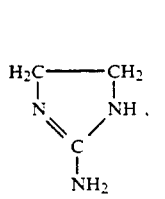

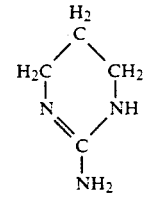

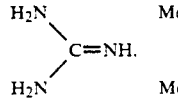

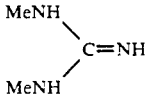

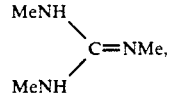

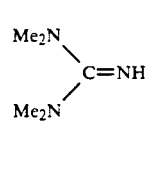

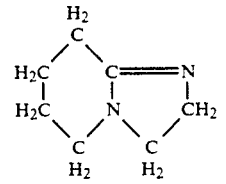

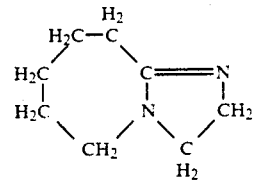

-continued

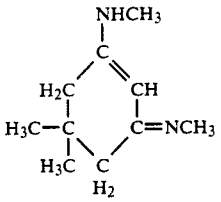

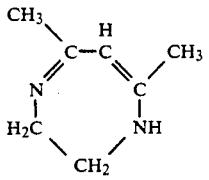

The base precursor used in the invention can be used in a wide range in terms of its amount. But it is suitably used in an amount of less than 50% by weight, preferably 0.01 to 40% by weight, as calculated on the basis of the weight of the coated surface of the dye-fixing layer. In the present invention, the base and/or base precursor may be used either alone or in admixture of two or more thereof.

The base and/or base precursor is usually dissolved in water or an alcohol and then dispersed in the dye-fixing layer. The dispersion may be performed in accordance with a method as disclosed in U.S. Pat. No. 2,322,027 in which an organic solvent having a high boiling point is used. Further, there may be employed a method in which the base and/or base precursor is dissolved in an organic solvent having a boiling point of about 30° to 160° C., such as lower alkyl acetates (e.g., ethyl acetate or butyl acetate), ethyl propionate, sec-butyl alcohol, methyl isobutyl ketone, 8-ethoxyethyl acetate, methyl cellosolve acetate, cyclohexane, etc., and then dispersed in the dye-fixing layer.

Examples of the organic solvent having a high boiling point include, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc. The above described organic solvents having a high boiling point and organic solvents having a low boiling point may be used as a mixture thereof. Further, it is possible to use a dispersion method using a polymer as described in Japanese Patent Publication No. 29853/76 and Japanese Patent Application (OPI) No. 59943/76.

The dye-fixing material of the invention may be constructed by plural layers of the dye-fixing layer and a layer or layers other than the dye-fixing layer, e.g., a protective layer, an interlayer, etc.

The dye-fixing layer of the invention is constructed by a single layer or plural layers and contains a dye mordant for fixing the dye. The base and/or base precursor is used by dispersing in a layer or layers containing the dye mordant. Alternatively, the base and/or base precursor may be used by dispersing in a binder in a layer adjacent to the layer containing the dye mordant. As the dye mordant, various mordants can be used. Among them are particularly preferred polymer mordants. The polymer mordant and the base and/or base precursor can be dispersed in the binder described below. The binder which can be used in the present invention can be employed individually or in a combination thereof. A hydrophilic binder can be preferably used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

When the dye mordant is a polymer mordant, the mordant also acts as a binder and hence, the amount of the binder may be reduced or the binder may not particularly be used. Contrarily, when the binder has a function as a mordant, the dye mordant may not be used. Any materials which are usually used as a binder for photographic light-sensitive materials can be used as the binder in the invention.

The mordant used for the dye-fixing layer of the invention can be properly selected from conventional mordants and among them, polymer mordants are particularly preferred.

Polymer mordants used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Patent 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

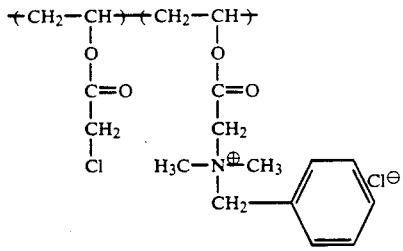

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

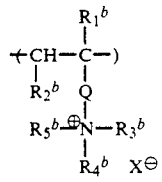

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded together to form a hetero ring, and X represents an anion. The above described alkyl groups and aryl groups may be substituted.

(3) Polymers represented by the following general formula

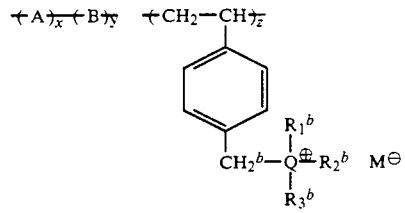

wherein x is from about 0.25 mol % to about 5 mol %, y is from about 0 mol % to about 90 mol %, z is from about 10 mol % to about 99 mol %, A represents a monomer having at least two ethylenically unsaturated bonds, B represents a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and M represents an anion.

(4) Copolymers composed of (a), (b) and (c), wherein (a) is

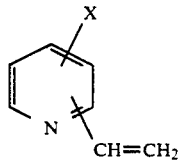

or

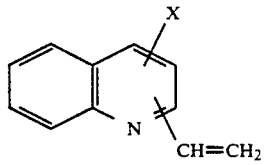

wherein X represents a hydrogen atom, an alkyl group or a halogen atom (the alkyl group may be substituted);

(b) is an acrylic ester; and (c) is acrylonitrile.

(5) Water-insoluble polymers wherein at least $\frac{1}{3}$ of the repeating units are those represented by the following general formula

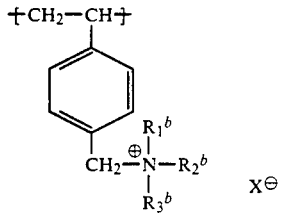

wherein $R_1^b$, $R_2^b$ and $R_3^b$ each represents an alkyl group, with the total number of carbon atoms included being 12 or more (the alkyl group may be substituted), and X represents an anion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from 20/80 to 80/20 (by weight) and the amount of the mordant coated is from 0.5 to 8 $g/m^2$.

A typical dye-fixing material used in the invention can be obtained by coating a mixture of a polymer containing an ammonium salt and gelatin on a transparent support.

When the dye-fixing layer is disposed on the surface of the dye-fixing material, a protective layer may be formed thereon, if desired. As such a protective layer, materials usually used for protective layers for photographic light-sensitive materials can be used, but when the dye-fixing layer is formed on a support different from the support of the light-sensitive material, it is preferred that the protective layer is rendered hydrophilic in order to prevent hindering the transfer of the hydrophilic dye.

As the support of the dye-fixing material of the invention, the above described support used in the light-sensitive material can be optionally chosen. However, organic polymers which are resistant to the heating for the development or the dye transfer are preferred.

Examples of the organic polymers used in the dye-fixing material of the invention include polystyrene having a molecular weight of 2,000 to 85,000, polystyrene derivatives having a substituent of up to 4 carbon atoms, polyvinylcyclohexane, polyvinylbenzene, polyvinylpyrrolidone, polyvinylcarbazole, polyallylbenzene, polyvinyl alcohol, polyacetals (e.g., polyvinylformal or polyvinylbutyral), polyvinyl chloride, chlorinated polyethylene, polyethylene trichlorofluoride, polyacrylonitrile, poly-N,N-dimethylallylamide, a polyacrylate having a p-cyanophenyl group, a pentachlorophenyl group, or a 2,4-dichlorophenyl group, polyacryl chloroacrylate, polymethyl methacrylate, polyethyl methacrylate, polypropyl methacrylate, polyisopropyl methacrylate, polyisobutyl methacrylate, poly-t-butyl methacrylate, polycyclohexyl methacrylate, polyethylene glycol dimethacrylate, poly-2-cyano-ethyl methacrylate, polyesters (e.g., polyethylene terephthalate), polysulfone, bisphenol A polycarbonate, polycarbonates, polyanhydrides, polyamides, and cellulose acetates. Also, synthetic polymers as described in *Polymer Handbook*, 2nd Edition (edited by J. Brandrup and E. H. Immergut), published by John Wiley & Sons Co. are useful as the organic polymers in this invention. These polymers may be used solely or as a combination of them.

Examples of the support advantageously used in this invention are films of cellulose acetates such as triacetate, diacetate, etc.; films of polyamides such as combinations of heptamethylenediamine and terephthalic acid, fluorenedipropylamine and adipic acid, hexamethylenediamine and diphenic acid, hexamethylenediamine and isophthalic acid, etc.; films of polyesters such as the combinations of diethylene glycol and diphenylcarboxylic acid, bis-p-carboxyphenoxybutane and ethylene glycol, etc.; polyethylene terephthalate films, polycarbonate films, etc. These films may be denatured. For example, a polyethylene terephthalate film denatured by using cyclohexane dimethanol, isophthalic acid, methoxypolyethylene glycol, 1,2-dicarbomethoxy-4-benzenesulfonic acid, etc., as a denaturant is advantageously used.

In the photographic light-sensitive material and the dye-fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

As the heating means for transferring the dye, various heating means as described above in regard to the heating means for the heat development can be used.

In the present invention, the light-sensitive material having the photosensitive layer and the dye-fixing layer on the same support or the dye-fixing material having the dye-fixing layer on a different support from that of the light-sensitive material can be prepared by coating respective coating compositions for the dye-fixing layer, protective layer, interlayer, subbing layer, backing layer, etc., in the same manners as described in the case of forming the photosensitive layer or other layer using a dipping method, an air knife method, a curtain coating method, or a hopper coating method as described in U.S. Pat. No. 3,681,294, followed by drying.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps,.laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The light-sensitive material to be sensitized by these lights is produced so as to release a yellow dye, a magenta dye and a cyan dye, respectively.

The light-sensitive material is produced using a construction such that the green-sensitive part (layer) contains a yellow dye releasing redox compound, the red-sensitive part (layer) contains a magenta dye releasing redox compound and the infrared-sensitive part (layer) contains a cyan dye releasing redox compound. Other combinations can be utilized, if necessary.

In addition to the above described methods of contacting or projecting the original, there is a method of exposure wherein the original illuminated by a light source is stored in a memory of a reading computer by means of a light-receiving element such as a phototube or a charge coupling device (CCD). The information is, if necessary, subjected to processing, the so-called image treatment, and resulting image information is reproduced on CRT which can be utilized as an image-like light source or lights are emitted by three kinds of LED according to the processed information.

The image-forming process of the invention is a very convenient image-forming process wherein the whole of steps from light exposure to heat development and dye-fixing can be performed in a completely dry system without particularly supplying a solvent from the outside. Furthermore, since in the image-forming process of the invention, not only sensitivity of a conventional so-called silver halide photographic material can be maintained but also dye image formed is fixed in the dye-fixing material, the quality and the preservative property of the dye image thus formed are very good, the color reproducibility is good, and in spite of the completely dry system, the reproduction of color images can be sufficiently performed.

The image-forming process of the invention having such excellent features can be applied for the field of photography as well as can meet the recent requirement for the transfer of so-called soft images to hard images. Moreover, in the image-forming process of the invention, the dye image formed is fixed in the dye-fixing layer, whereby the dye image has a good preservative property and hence, the process of the invention can be conveniently utilized even in the case of requiring the preservation of dye images for a long period of time. Thus, the image-forming process of the invention exceeds conventional photographic techniques in the foregoing points.

Then, the invention will further be explained below in detail by the following examples but the invention is not limited to them.

EXAMPLE 1

Preparation of light-sensitive material D-1

A silver iodobromide emulsion was prepared by the following manner.

In 3,000 ml of water were dissolved 40 g of gelatin and 26 g of potassium bromide and the solution was stirred at 50° C. Then, a solution of 34 g of silver nitrate dissolved in 200 ml of water was added to the foregoing solution for 10 minutes and thereafter, a solution of 3.3 g of potassium iodide dissolved in 100 ml of water was added to the foregoing solution over a two minute period to provide a silver iodobromide emulsion. The pH of the silver iodobromide emulsion thus obtained was adjusted to cause sedimentation, and after removing excessive salts, the pH of the emulsion was adjusted to 6.0 to provide 400 g of the silver iodobromide emulsion.

Then, a benzotriazole silver emulsion was prepared by the following manner.

In 3,000 ml of water were dissolved 28 g of gelatin and 13.2 g of benzotriazole and the resultant solution was stirred at 40° C. To the solution was added a solution of 17 g of silver nitrate dissolved in 100 ml of water over a two minute period. The pH of the benzotriazole silver emulsion thus formed was adjusted to cause sedimentation, and after removing excessive salts, the pH of the emulsion was adjusted to 6.0 to provide 400 g of the benzotriazole silver emulsion.

Then, a gelatin dispersion of a dye releasing redox compound was prepared by the following manner.

In 20 ml of ethyl acetate were dissolved 5 g of the magenta dye releasing redox compound (42), 0.5 g of a surface active agent, succinic acid 2-ethylhexyl ester sodium sulfonate, and 5 g of tricresyl phosphate (TCP) under heating to about 60° C. to form a homogeneous solution. The solution was mixed with 100 g of an aqueous solution of 10% limed gelatin with stirring and mixture was treated by means of a homogenizer for 10 minutes at 10,000 r.p.m. to provide a dispersion of the magenta dye releasing redox compound.

A photosensitive layer was formed as follows.

| | | |
|---|---|---|
| (a) | Silver iodobromide emulsion | 20 g |
| (b) | Benzotriazole silver emulsion | 10 g |
| (c) | Gelatin dispersion of dye | 33 g |

-continued

| | | |
|---|---|---|
| | releasing redox compound (42) | |
| (d) | Aqueous solution of 2.5% compound (A) having the following structure | 10 ml |

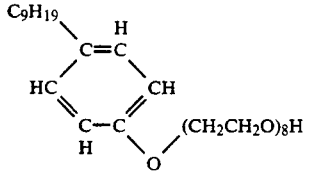

| | | |
|---|---|---|
| (e) | Ethanol solution of 10% guanidine trichloroacetate | 12.5 ml |
| (f) | Aqueous solution of 10% dimethyl sulfamide | 4 ml |

Foregoing components (a) to (f) were mixed under heating to provide a photosensitive coating composition and the coating composition thus prepared was coated on a polyethylene terephthalate film of 180 μm in thickness at a wet thickness of 30 μm.

Furthermore, a protective layer was formed on the photosensitive layer thus formed by the following manner.

| | | |
|---|---|---|
| (g) | Aqueous solution of 10% gelatin | 35 g |
| (h) | Ethanol solution of 10% guanidine trichloroacetate | 5 ml |
| (i) | Aqueous solution of 1% succinic acid-2-ethylhexyl ester sodium solfonate | 4 ml |
| (j) | Water | 56 ml |

A mixture of the foregoing components was coated on the photosensitive layer at a wet thickness of 25 μm and then dried to provide light-sensitive material D-1.

EXAMPLE 2

Preparation of light-sensitive material D-2

By following the same procedure as in Example 1 except that dye releasing redox compound (68) was used in place of dye releasing redox compound (42) used in Example 1 and 5 g of the silver iodobromide emulsion was used in place of 10 g of the benzotriazole silver emulsion used for the photosensitive coating composition, light-sensitive material D-2 was prepared.

EXAMPLE 3

Preparation of light-sensitive material D-3

In 1,000 ml of water were dissolved 6.5 g of benzotriazole and 10 g of gelatin, and the solution was stirred at 50° C. Then, a solution of 8.5 g of silver nitrate dissolved in 100 ml of water was added to the foregoing solution over a two minute period and further, a solution of 1.2 g of potassium bromide dissolved in 50 m( of water was also added to the solution over a two minute period. The pH of the emulsion thus prepared was adjusted to cause sedimentation, and after removing excessive salts, the pH of the emulsion was adjusted to 6.0 to provide 200 g of the emulsion.

Then, by following the same procedure as in Example 1 except that 25 g of the foregoing benzotriazole silver emulsion containing photosensitive silver bromide was used in place of the silver iodobromide emulsion and the benzotriazole silver emulsion used for the photo-sensitive coating composition in Example 1 and further dye releasing redox compound (21) was used in place of dye releasing redox compound (42), light-sensitive material D-3 was prepared.

EXAMPLE 4

Preparation of light-sensitive materials D-4 to 6

By following the same procedures as in Examples 1 to 3 except that guanidine trichloroacetate used in Examples 1 to 3 were not used, light-sensitive materials D-4 to 6 were prepared.

EXAMPLE 5

Preparation of light-sensitive material D-7

By following the same procedure as in Example 1 except that the amount (220 mg) of guanidine trichloroacetate used in Example 1 was reduced to 1/2 of the amount, i.e., to 110 mg, light-sensitive material D-7 was prepared.

EXAMPLE 6

Preparation of dye-fixing material R-1

In 200 ml of water was dissolved 10 g of poly(methyl acrylate-co-N,N,N-trimethyl-N-vinylbenzyl ammonium chloride) (the ratio of methyl acrylate to vinylbenzyl ammonium chloride being 1:1) and the solution was uniformly mixed with 100 g of an aqueous solution of 10% limed gelatin. The mixture was uniformly coated on a polyethylene terephthalate film at a wet thickness of 90 μm.

After mixing components (k) to (o) shown below, the mixture was uniformly coated on the layer thus formed at a wet thickness of 60 μm and dried. Hereinafter, the 2nd layer was called as a hydrophilic thermal solvent layer.

| | | |
|---|---|---|
| (k) | Urea (hydrophilic thermal solvent) | 4 g |
| (l) | Water | 10 ml |
| (m) | Aqueous solution of 10 wt % polyvinyl alcohol (saponification degree: 98%) | 12 g |
| (n) | Compound A used in Example 1 | 100 mg |
| (o) | Aqueous solution of 5% sodium dodecylbenzenesulfonate | 0.5 ml |

EXAMPLES 7 TO 9

Preparation of dye-fixing materials R-2, R-3 and R-4

By following the same procedure as in Example 6 except that 4 g of pyridine N-oxide was used in place of 4 g of urea used in Example 6 as the hydrophilic thermal solvent, dye-fixing material R-2 was prepared.

Also, by following the same procedure as above using 4 g of sulfonamide and 4 g of acetamide, respectively, as the hydrophilic thermal solvent, dye-fixing materials R-3 and R-4 were prepared, respectively.

EXAMPLES 10 AND 11

Preparation of dye-fixing materials R-5 and R-6

By following the same procedure as in Example 6 except that a mixture of 2 g of urea and 2 g of N-methylurea was used in place of 4 g of urea used in Example 6 as the hydrophilic thermal solvent, dye-fixing material R-5 was prepared.

Also, by following the same procedure as in Example 6 except that a mixture of 1 g of urea, 1 g of N-methylurea, 1 g of ethylurea, and 1 g of ethylene urea was used in place of 4 g of urea used in Example 6, dye-fixing material R-6 was prepared.

EXAMPLES 12 TO 14

Preparation of dye-fixing materials R-7 to R-9

By following the same procedure as in Example 6 except 6 except that 0.8 g of guanidine trichloroacetate was added to the coating composition for the 2nd layer (hydrophilic thermal solvent layer) in Example 6, dye-fixing material R-7 was prepared.

Also, by following the same procedure as in Example 6 except that each of 0.4 g of guanidine trichloroacetate and 0.4 g of sodium carbonate was added to the coating composition for the 2nd layer in Example 6, dye-fixing materials R-8 and R-9 were prepared, respectively.

EXAMPLE 15

Light-sensitive material D-1 was image-wise exposed for 10 seconds using a tungsten lamp at 2,000 lux and thereafter was uniformly heated for 20 seconds on a heat block heated to 140° C.

Then, each of dye-fixing materials R-1 to R-9 was closely brought into contact with the light-sensitive material so that the coated layers were in a face-to-face relationship with each other and each assembly was heated for 30 seconds on a heat block at 120° C.

When each dye-fixing material was peeled off from the light-sensitive material, a negative magenta image was obtained on each dye-fixing material. The density of the negative image thus formed was measured using a Macbeth densitometer (RD-504) and the results are shown in Table 1.

TABLE 1

| Dye-fixing material | Hydrophilic thermal solvent | Maximum density | Minimum density (unexposed area) |
|---|---|---|---|
| R-1 | urea | 1.20 | 0.13 |
| R-2 | pyridine N-oxide | 1.15 | 0.12 |
| R-3 | sulfonamide | 0.99 | 0.14 |
| R-4 | acetamide | 0.98 | 0.10 |
| R-5 | urea/N-methylurea | 1.23 | 0.14 |
| R-6 | urea/N-methylurea/ethylurea/ethylene urea | 1.25 | 0.15 |
| R-7 | urea | 1.28 | 0.22 |
| R-8 | urea | 1.26 | 0 18 |
| R-9 | urea | 1.21 | 0.19 |

From the foregoing results, it has been confirmed that images of the high maximum density are obtained without supplying water by using the dye-fixing materials containing the hydrophilic thermal solvents, respectively, and also particularly sharp images are obtained in the case of using the dye-fixing materials (R-5 and R-6) containing two or more kinds of the hydrophilic thermal solvents.

EXAMPLE 16

Each of light-sensitive materials D-1 to D-3 in Examples 1 to 3 was exposed and heat developed as in Example 15. Each of the light-sensitive materials was closely brought into contact with dye-fixing material R-1 shown in Example 6 with the coated layers in a face-to-face relationship and each assembly was heated for 30 seconds on a heat block at 120° C. When the dye-fixing material was peeled off from each of the light-sensitive sheets, each of negative magenta, yellow, and cyan images was obtained on the dye-fixing material. The densities of each negative image thus obtained were measured using a Macbeth densitometer (RD-504) and the results are shown in Table 2.

TABLE 2

| Light-sensitive Material | Dye releasing redox compound | Hue | Maximum density | Minimum density |
|---|---|---|---|---|
| D-1 | Compound (42) | magenta | 1.20 | 0.13 |
| D-2 | Compound (68) | yellow | 1.25 | 0.12 |
| D-3 | Compound (21) | cyan | 1.10 | 0.18 |

From the above results, it has been confirmed that the image of high cyan, magenta, or yellow maximum density was obtained without supplying water by using the dye-fixing material containing the hydrophilic thermal solvent.

EXAMPLE 17

Each of light-sensitive materials D-4 to D-6 in Example 6 was image-wise exposed for 10 seconds using a tungsten lamp at 2,000 lux. Each of the light-sensitive materials was closely brought into contact with dye-fixing material R-8 in Example 13 with the coated layers in a face-to-face relationship with each other and each assembly was heated for 30 seconds on a heat block of 130° C.

When the dye-fixing material was peeled off from each light-sensitive sheet, negative magenta, yellow, and cyan images were formed on the dye-fixing material respectively. The densities of each negative image thus formed were measured using a Macbeth densitometer (RD-504) and the results are shown in Table 3.

TABLE 3

| Light-sensitive Material | Dye releasing redox compound | Hue | Maximum density | Minimum density |
|---|---|---|---|---|
| D-1 | Compound (42) | magenta | 1.16 | 0.15 |
| D-2 | Compound (68) | yellow | 1.20 | 0.16 |
| D-3 | Compound (21) | cyan | 1.03 | 0.20 |

From the above results, it has been confirmed that images of high maximum density are obtained in the case of performing heat development and dye transfer simultaneously by using the dye-fixing material containing the hydrophilic thermal solvent.

EXAMPLE 18

The light exposure, heat development and transfer were performed in the same manner as in Example 17 except that dye-fixing material R-9 was used in place of dye-fixing material R-8 used in Example 17 and as the result, each of negative magenta, yellow and cyan images was obtained on the dye-fixing material as in the case of using R-8.

EXAMPLE 19

By following the same procedure as in Example 1 except that 1.5 g of hydrophilic thermal solvent (1), urea was added to the photosensitive coating composition for the light-sensitive material D-1 in Example 1, light-sensitive material D-8 was prepared.

Furthermore, by following the same procedure as in Example 6 except- that in dye-fixing material R-1 in Example 6, the coating amount of urea in the hydrophilic thermal solvent layer was reduced to ½ of the amount thereof in Example 6, dye-fixing material R-10 was prepared.

Light-sensitive material D-8 was image-wise exposed for 10 seconds using a tungsten lamp at 2,000 lux and thereafter was uniformly heated for 20 seconds to 130° C. Then, the light-sensitive material was closely brought into contact with dye-fixing material R-10 with the coated layer in a face-to-face relationship with each other and the assembly was heated for 20 seconds to 120° C. When the dye-fixing material was peeled off from the light-sensitive material, a negative magenta image having a high density was obtained on the dye-fixing material. When the density of the negative color image was measured using a Macbeth densitometer (RD-504), the maximum density was 1.22 and the minimum density was 0.19. Thus, it has been confirmed that a dye image having a high density can be obtained by heating in a short period of time without supplying water by incorporating the hydrophilic thermal solvent in the light-sensitive material.

EXAMPLE 20

Dye-fixing material R-11 used in the invention was prepared as follows.

In 200 ml of water were dissolved 10 g of poly(methyl acrylate-co-N,N,N-trimethyl-N-vinylbenzyl ammonium chloride) (ratio of methyl acrylate to vinylbenzyl ammonium chloride being 1:1) and 25 g of hydrophilic thermal solvent (1) and the solution was uniformly mixed with 100 g of an aqueous solution of 10% limed gelatin. The mixture was uniformly coated on a polyethylene terephthalate film at a wet thickness of 90 μm.

On the layer thus formed was coated polyvinyl alcohol at a dry thickness of 1.5 μm to provide dye-fixing material R-11.

Light-sensitive material D-1 was image-wise exposed for 10 minutes using a tungsten lamp at 2,000 lux and thereafter was uniformly heated for 20 seconds on a heat block heated to 140° C.

Then, the light-sensitive material was closely brought into contact with dye-fixing material R-11 with the coated layers in a face-to-face relationship with each other and the assembly was heated for 30 seconds on a heat block at 120° C.

When the dye-fixing material was peeled off from the light-sensitive material, a negative magenta image was obtained on the dye-fixing material. When the densities of the negative image thus obtained were measured using a Macbeth densitometer (RD-504), the maximum density was 1.26 and the minimum density was 0.18.

Thus, it has been confirmed that a color image having the high maximum density is obtained without supplying water by using the dye-fixing material containing the hydrophilic thermal solvent in the dye-fixing layer.

EXAMPLE 21

In 3,000 ml of water were dissolved 40 g of gelatin and 26 g of potassium bromide and the solution was stirred at 50° C. Then, a solution of 34 g of silver nitrate dissolved in 200 ml of water was added to the foregoing solution and thereafter, a solution of 3.3 g of potassium iodide dissolved in 100 ml of water was added to the foregoing solution over a two minute period to provide a silver iodobromide emulsion. The pH of the silver iodobromide emulsion thus obtained was adjusted to cause sedimentation and after removing excessive salts, the pH of the emulsion was adjusted to 6.0 to provide 400 g of the silver iodobromide emulsion.

Then, a gelatin dispersion of a dye releasing redox compound was prepared by the following manner.

In 30 ml of ethyl acetate were dissolved 5 g of the magenta dye releasing redox compound (42), 0.5 g of a surface active agent, succinic acid 2-ethylhexyl ester sodium sulfonate, and 5 g of tricresyl phosphate (TCP) under heating to about 60° C. to form a homogeneous solution. The solution was mixed with 100 g of an aqueous solution of 10% limed gelatin with stirring and the mixture was treated by means of a homogenizer for 10 minutes at 10,000 r.p.m. to provide a dispersion of the magenta dye releasing redox compound.

Then, a photosensitive coating composition was prepared by the following manner.

| | | |
|---|---|---|
| (a) | Photosensitive silver iodobromide emulsion | 25 g |
| (b) | Dispersion of dye releasing redox compound | 33 g |
| (c) | Aqueous solution of 5% compound having the following structure | 5 ml |

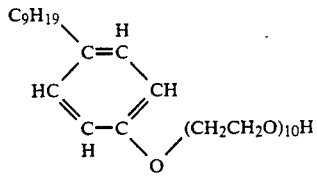

| | | |
|---|---|---|
| (d) | Aqueous solution of 10% compound having the following structure $H_2N—SO_2—N(CH_3)_2$ | 4 ml |
| (e) | Water | 20 ml |

Foregoing components (a) to (e) were mixed under heating to provide a photosensitive coating composition and the coating composition thus prepared was coated on a polyethylene terephthalate film of 180 μm in thickness at a wet thickness of 30 μm.

Furthermore, a protective layer was formed on the photosensitive layer thus formed by the following manner.

| | | |
|---|---|---|
| (a) | Aqueous solution of 10% gelatin | 35 g |
| (b) | Aqueous solution of 1% succinic acid-2-ethylhexyl ester sodium sulfonate | 4 ml |
| (c) | Water | 61 ml |

A mixture of the foregoing components was coated on the photosensitive layer at a wet thickness of 25 μm.

Then, a dye-fixing material containing a dye-fixing agent was by the following manner.

In 200 ml of water was dissolved 10 g of poly(methyl acrylate-co-N,N,N-trimethyl-N-vinylbenzyl ammonium chloride) (the ratio of methyl acrylate to vinylbenzyl ammonium chloride being 1:1) and the solution was uniformly mixed with 100 g of an aqueous solution of 10% limed gelatin. The mixture was uniformly coated on a 120 μm-thick polyethylene terephthalate film having dispersed therein titanium dioxide at a wet thickness of 90 μm.

After mixing and dissolving components (a) to (e) shown below, the solution (hereinafter "solution A") was uniformly coated on the layer thus formed at a wet thickness of 60 μm.

| | | |
|---|---|---|
| (a) | Urea (hydrophilic heat solvent) | 4 g |
| (b) | Water | 10 ml |
| (c) | Aqueous solution of 10 wt. % polyvinyl alcohol (saponification degree: 98%) | 12 g |
| (d) | Compound having the following structure | 100 mg |

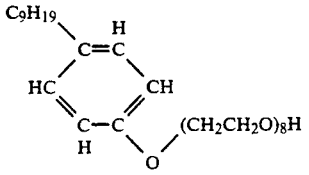

| | | |
|---|---|---|
| (e) | Aqueous solution of 5% sodium dodecylbenzenesulfonate | 0.5 ml |

This coating sample was dried and used as a dye-fixing material (hereinafter "sheet A"). The same procedure as above was repeated except that 0.4 g of sodium carbonate was used as a base in the solution A to prepare a coating solution (hereinafter "solution B"). Using this solution B, a dye-fixing material was obtained in the same manner as above (this dye-fixing material being hereinafter referred to "sheet B").

The light-sensitive material as obtained above was image-wise exposed for 10 seconds using a tungsten lamp at 2,000 lux.

Then, each of the dye-fixing materials as prepared above was closely brought into contact with the light-sensitive material so that the coated layers were in a face-to-face relationship with each other and each assembly was heated for 30 seconds on a heat block at 130° C.

When each dye-fixing material was peeled off from the light-sensitive material, a negative magenta image was obtained on only sheet B. The density of the negative image thus formed was measured using a Macbeth densitometer (RD-519) and the results are shown below.

| Dye-fixing Material | Maximum density | Minimum density |
|---|---|---|
| A (Comparison) | 0.13 | 0.13 |
| B (Invention) | 1.70 | 0.22 |

From the foregoing results, it has been confirmed that images of the high maximum density are obtained by using the dye-fixing material of this invention.

EXAMPLE 22

A sample was prepared in the same manner as in Example 21 except that 0.8 g of guanidine trichloroacetate was used as a base precursor in the solution A, and then treated in the same manner as in Example 21. The results obtained are shown below.

| Dye-fixing Material | Maximum density | Minimum density |
|---|---|---|
| A (Comparison) | 0.12 | 0.12 |
| C (Invention) | 1.67 | 0.26 |

EXAMPLE 23

The same procedure as in Example 21 was repeated except that each of the dye releasing redox compounds as shown below was used in place of the dye releasing redox compound (42). Thus, a dispersion of dye releasing redox compound was prepared.

| | |
|---|---|
| Dye releasing redox compound (10) | 5 g |
| Dye releasing redox compound (68) | 7.5 g |
| Dye releasing redox compound (21) | 5 g |

Each sample was prepared in the same manner as in Example 21. Then, the sample was treated in the same manner as in Example 21. The results obtained are shown below.

| Dispersion of dye releasing redox compound | Dye-fixing material | Maximum density | Minimum density |
|---|---|---|---|
| Dispersion of (10) | A (Comparison) | 0.12 | 0.12 |
| (magenta) | B (Invention) | 1.64 | 0.25 |
| Dispersion of (68) | A (Comparison) | 0.13 | 0.13 |
| (yellow) | B (Invention) | 1.50 | 0.26 |
| Dispersion of (21) | A (Comparison) | 0.10 | 0.10 |
| (cyan) | B (Invention) | 2.00 | 0.33 |

From the foregoing results, it has been confirmed that images of the high maximum density are obtained by using the dye-fixing material of this invention.

EXAMPLE 24

Example 24 is an example in which an organic silver salt oxidizing agent was used.

A benzotriazole silver emulsion was prepared by the following manner.

In 3,000 ml of water were dissolved 28 g of gelatin and 13.2 g of benzotriazole and the solution was stirred at 40° C. Then, a solution of 17 g of silver nitrate dissolved in 100 ml of water was added to the foregoing solution over a two minute period. The pH of the thus obtained benzotriazole silver emulsion was adjusted to cause sedimentation and after removing excessive salts, the pH of the emulsion was adjusted to 6.0 to provide 400 g of the benzotriazole silver emulsion.

Then, using this benzotriazole silver emulsion, a photosensitive coating composition was prepared by the following manner.

| | | |
|---|---|---|
| (a) | Silver iodobromide emulsion (as in Example 21) | 20 g |
| (b) | Benzotriazole silver emulsion | 10 g |
| (c) | Dispersion of dye releasing redox compound as in Example 21 | 33 g |
| (d) | Aqueous solution of 5% compound having the following structure | 5 ml |

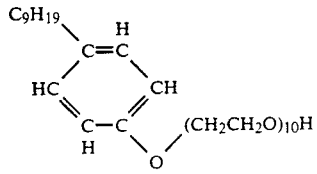

| | | |
|---|---|---|
| (e) | Aqueous solution of 10% compound having the following structure $H_2NSO_2N(CH_3)_2$ | 4 ml |

-continued

| | | |
|---|---|---|
| (f) | Water | 20 ml |

Foregoing components (a) to (f) were mixed and the same procedure as in Example 21 was repeated to prepare a sample.

As the dye-fixing material, the sheet A and sheet B as used in Example 21 were respectively used.

The light-sensitive material as obtained above was image-wise exposed for 10 seconds using a tungsten lamp at 2,000 lux.

Then, each of the dye-fixing materials (sheet A and sheet B) was closely brought into contact with the exposed light-sensitive material so that the coated layers were in a face-to-face relationship with each other and each assembly was heated for 30 seconds on a heat block at 130° C.

When each dye-fixing material was peeled off from the light-sensitive material, a negative magenta image was obtained on only sheet B. The density of the negative image thus formed was measured using a Macbeth densitometer (RD-519) and the results are shown below.

| Dye-fixing Material | Maximum density | Minimum density |
|---|---|---|
| A (Comparison) | 0.14 | 0.13 |
| B (Invention) | 1.81 | 0.25 |

From the foregoing results, it has been confirmed that images of the high maximum density are obtained by using the dye-fixing material of this invention.

EXAMPLE 25

After mixing components (a) to (f) shown below, each of the solution (hereinafter "solutions D,E,F,G and H", respectively) was uniformly coated on a layer containing the dye-fixing agent as in Example 21 at a wet thickness of 60 μm. Then, each coated sample was dried to prepare dye-fixing materials (hereinafter "sheets D, E, F, G and H", respectively).

| | | |
|---|---|---|
| (a) | Water | 10 ml |
| (b) | Aqueous solution of polyvinyl alcohol (saponification degree: 98%) | 12 g |
| (c) | Compound having the following structure | 100 mg |

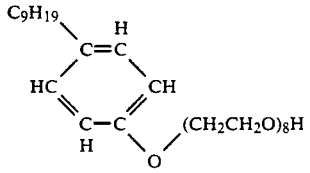

| | | |
|---|---|---|
| (d) | Aqueous solution of 5% sodium dodecylbenzenesulfonate | 0.5 ml |
| (e) | Guanidine trichloroacetate | 0.4 g |

With respect to the foregoing components (a) to (e), D, E, F, G and H are common to each another, the hydrophilic thermal solvents used are as follows.

-continued

| | | |
|---|---|---|
| D: | Pyridine N-oxide | 4 g |
| E: | Sulfonamide | 4 g |
| F: | Acetamide | 4 g |
| G: | Urea and N-methylurea | 2 g (each) |
| H: | Urea, N-methylurea, ethylene urea and ethylurea | 1 g (each) |

The light-sensitive material as obtained in Example 24 was image-wise exposed for 10 seconds using a tungsten lamp at 2,000 lux.

Then, each of the dye-fixing materials was closely brought into contact with the exposed light-sensitive material so that the coated layers were in a face-to-face relationship with each other and each assembly was heated for 30 seconds on a heat block at 130° C.

When each dye-fixing material was peeled off from the light-sensitive material, a negative magenta image was obtained. The density of the negative image thus formed was measured using a Macbeth densitomer (RD-519) and the results are shown below.

| Dye-fixing Material | Maximum density | Minimum density |
|---|---|---|
| D | 1.76 | 0.24 |
| E | 1.85 | 0.26 |
| F | 1.60 | 0.22 |
| G | 1.86 | 0.26 |
| H | 1.90 | 0.28 |

From the foregoing results, it has been confirmed that images of the high maximum density are obtained by using the dye-fixing material of this invention.

While the invention has been described in detail and with reference to specific embodiment thereof, it will be apparent to one skilled in the art that various changes and modifications can be made therein without departing from the spirit and scope thereof.

What is claimed is:

1. A dry image-forming process in which a transfer solvent liquid at room temperature is not employed, which comprises (1) heat developing in the absence of a transfer solvent, a light-sensitive material not containing said transfer solvent and comprising a support having thereon at least a photosensitive silver halide, a binder, and a dye releasing redox compound, said dye releasing redox compound being reductive to the photosensitive silver halide and being capable of releasing a hydrophilic dye upon reaction with the photosensitive silver halide under heating, after or simultaneously with image-wise exposure, to form image-wise a mobile hydrophilic dye and (2) heating, after or simultaneously with the heat development, in the absence of said transfer solvent, the light-sensitive material together with a dye-fixing material which does not contain said transfer solvent and which comprises a support having thereon a dye-fixing layer, a dye-fixing agent, a hydrophilic thermal solvent, a base and/or base precursor, said hydrophilic thermal solvent being a non-hydrolyzable organic material which is solid at an ambient temperature but melts together with other components at the temperature of heating or below, said thermal solvent having a melting point of 40° C. to 250° C., in a coating amount of 20 to 200 percent by weight, based on the total coating amount of the coating compositions for the light-sensitive material and the dye-fixing material, to thereby transfer the mobile hydrophilic dye onto the dye-fixing layer without the use of said transfer solvent, to form a dye image and fix the dye image, so that the mobile hydrophilic dye transfers into the dye-fixing material without use of said transfer solvent, to form a dye image and fix the dye image in said dye-fixing layer.

2. A process as claimed in claim 1, wherein the heat development is carried out in a state containing substantially no water.

3. A process as claimed in claim 1, wherein said dye releasing redox compound is a compound represented by the following general formula (I):

$$Ra—SO_2—D \quad (I)$$

wherein Ra represents a reducing group capable of being oxidized by the silver halide; and D represents an image forming dye portion containing a hydrophilic group.

4. A process as claimed in claim 1, wherein said photosensitive silver halide is silver chloroiodide, silver iodobromide, or silver chloroiodobromide.

5. A process as claimed in claim 1, wherein an organic silver salt oxidizing agent is co-present together with said photosensitive silver halide.

6. A process as claimed in claim 5, wherein said organic silver salt oxidizing agent is a silver salt of an aliphatic carboxylic acid or a silver salt of an aromatic carboxylic acid.

7. A process as claimed in claim 1, wherein said light-sensitive material further comprises a dye releasing activator.

8. A process as claimed in claim 7, wherein said dye releasing activator is a base and/or a base precursor.

9. A process as claimed in claim 1, wherein the heating for the development is carried out at a temperature of 80° C. to 250° C.

10. A process as claimed in claim 1, wherein the heating for the transfer is carried out at a temperature of 60° C. to 250° C.

11. A process as claimed in claim 1, wherein said hydrophilic thermal solvent is a non-hydrolyzable organic material which is solid at an ambient temperature but melts together with other components at a temperature of heat treatment or below.

12. A process as claimed in claim 11, wherein said hydrophilic thermal solvent has an (inorganic property-/organic property) value of larger than 1 and a solubility in water at room temperature of higher than 1.

13. A process as claimed in claim 1, wherein said dye-fixing agent is a dye mordant.

14. A process as claimed in claim 1, wherein said support is identical to the support of said light-sensitive material.

15. A process as claimed in claim 1, wherein said support is a different support from the support of said light-sensitive material.

* * * * *